US010428455B2

(12) United States Patent
Gladish et al.

(10) Patent No.: US 10,428,455 B2
(45) Date of Patent: Oct. 1, 2019

(54) PLASMA TREATMENTS FOR COLORATION OF TEXTILES, FIBERS AND OTHER SUBSTRATES

(71) Applicant: The North Face Apparel Corp., Wilmington, DE (US)

(72) Inventors: Justin Lee Gladish, Portland, OR (US); Mary-Ellen Smith, Kihei, HI (US); Graham C. Page, Alameda, CA (US)

(73) Assignee: The North Face Apparel Corp., Wilmington, DE (US)

( * ) Notice: Subject to any disclaimer, the term of this patent is extended or adjusted under 35 U.S.C. 154(b) by 0 days.

(21) Appl. No.: 15/103,849

(22) PCT Filed: Dec. 5, 2014

(86) PCT No.: PCT/US2014/068911
§ 371 (c)(1),
(2) Date: Jun. 10, 2016

(87) PCT Pub. No.: WO2015/088920
PCT Pub. Date: Jun. 18, 2015

(65) Prior Publication Data

US 2016/0326692 A1 Nov. 10, 2016

Related U.S. Application Data

(60) Provisional application No. 61/915,942, filed on Dec. 13, 2013.

(51) Int. Cl.
*D06P 5/20* (2006.01)

(52) U.S. Cl.
CPC ..... *D06P 5/2016* (2013.01); *D06P 5/2011* (2013.01)

(58) Field of Classification Search
CPC ..... D06P 5/2011; D06P 5/2016
See application file for complete search history.

(56) References Cited

U.S. PATENT DOCUMENTS

| | | | | |
|---|---|---|---|---|
| 5,391,855 | A | 2/1995 | Tanisaki | |
| 5,895,558 | A * | 4/1999 | Spence | H01J 37/32 204/164 |
| 5,961,772 | A | 10/1999 | Selwyn | |
| 6,083,355 | A * | 7/2000 | Spence | B29C 59/14 204/164 |
| 6,118,218 | A | 9/2000 | Yializis et al. | |
| 6,479,595 | B1 * | 11/2002 | Zhang | B01J 19/088 204/165 |
| 6,677,243 | B2 | 1/2004 | Okada et al. | |
| 7,025,856 | B2 | 4/2006 | Selwyn et al. | |
| 7,067,405 | B2 | 6/2006 | Mikhael et al. | |
| 7,666,478 | B2 | 2/2010 | Paulussen et al. | |
| 8,016,894 | B2 | 9/2011 | Selwyn et al. | |
| 8,029,872 | B2 | 10/2011 | Ward | |
| 8,163,356 | B2 | 4/2012 | Coulson | |
| RE43,651 | E | 9/2012 | Badyal et al. | |
| 8,361,276 | B2 | 1/2013 | Selwyn | |
| 8,524,372 | B2 | 9/2013 | Coulson | |
| 2004/0152381 | A1 | 8/2004 | York et al. | |
| 2006/0040053 | A1 | 2/2006 | Gleason et al. | |
| 2007/0237947 | A1 | 10/2007 | Gleason et al. | |
| 2008/0107822 | A1 | 5/2008 | Selwyn et al. | |
| 2009/0170391 | A1 | 7/2009 | Coulson | |
| 2009/0304549 | A1 | 12/2009 | Coulson | |
| 2010/0189914 | A1 | 7/2010 | Coulson | |
| 2010/0203347 | A1 | 8/2010 | Coulson | |
| 2010/0293812 | A1 | 11/2010 | Coulson | |
| 2011/0114555 | A1 | 5/2011 | Coulson et al. | |
| 2011/0259455 | A1 | 10/2011 | King | |
| 2012/0024017 | A1 * | 2/2012 | Jiang | D06B 3/28 68/131 |
| 2013/0117978 | A1 | 5/2013 | Carr et al. | |

FOREIGN PATENT DOCUMENTS

| | | | |
|---|---|---|---|
| CN | 1641447 | A | 7/2005 |
| DE | 102013212284 | | 1/2014 |
| JP | S5299400 | A | 8/1977 |

(Continued)

OTHER PUBLICATIONS

Office Action issued by the State Intellectual Property Office of China in Chinese Patent Application No. 2014800753305, dated May 12, 2017.
Extended European Search Report issued by European Patent Office in European Patent Application No. 14869878.0, dated Jun. 26, 2017.
Cotton Incorporated. Technical Bulletin: Dying Cationic Pretreated Cotton. TRI 3016.
Salas et al. Water-Wettable Polypropylene Fibers by Facile Surface Treatment Based on Soy Proteins. ACS Appl. Mater. Interfaces, 2013, 5 (14), pp. 6541-6548.
Goli et al. Generation of Functional Coatings on Hydrophobic Surfaces through Deposition of Denatured Proteins Followed by Grafting from Polymerization. Biomacromolecules, 2012, 13 (5) pp. 1371-1382.
International Search Report and Written Opinion in International Application No. PCT/US14/068911 dated Apr. 13, 2015.
International Preliminary Report on Patentability in International Application No. PCT/US14/068911 dated Jun. 14, 2016.
Communication under 94(3) for European Patent Application No. 14869878.0, dated Apr. 3, 2018.

(Continued)

*Primary Examiner* — Amina S Khan
(74) *Attorney, Agent, or Firm* — Ganz Pollard, LLC

(57) ABSTRACT

A method of treating a substrate, comprising providing a substrate having a generally sheet or planar form or a fiber or yarn form; providing a colorant to be set at the surface of the substrate; and subjecting the substrate and colorant to reactive species from a plasma generated by an atmospheric plasma apparatus until the colorant is set at the surface of the substrate. A method of setting a colorant on a substrate, comprising performing an etch operation, or plasma pre-treatment to change surface charge, on a substrate using a plasma, particularly a plasma generated at atmospheric conditions, to create a desired surface texture, or surface charge, at the surface of substrate; and depositing a colorant on the surface under plasma or non-plasma conditions; and allowing the colorant to set at the surface of the substrate.

18 Claims, 3 Drawing Sheets

(56) References Cited

FOREIGN PATENT DOCUMENTS

| | | | | |
|---|---|---|---|---|
| JP | 02047378 | | * | 2/1990 |
| JP | H0247378 | A | | 2/1990 |
| JP | H02259160 | A | | 10/1990 |
| JP | 2010100953 | A | | 5/2010 |
| SU | 1489229 | A1 | | 10/1992 |
| WO | 2005038125 | | | 4/2005 |
| WO | WO 2005/038125 | | * | 4/2005 |
| WO | 2006117829 | | | 11/2006 |
| WO | 2008057759 | | | 5/2008 |
| WO | 2013001306 | | | 1/2013 |

OTHER PUBLICATIONS

Second Office Action with English Translation for Chinese Application No. 2014800753305, dated Feb. 11, 2018.
Office Action in European Application No. 14869878.0, mailed Dec. 20, 2018, 4 pp.

* cited by examiner

1. A series of Applicators/ plasma sources could be used or substrate could be reversed in a single setup of application/plasma source
2. Applicator and plasma source could be in same chamber or enclosure. Applicator and plasma source could be in simultaneous operation or sequential operation.

PLASMA TREATMENTS FOR COLORATION OF TEXTILES, FIBERS AND OTHER SUBSTRATES

RELATED APPLICATIONS

This application claims the benefit of and priority to U.S. Provisional Application Ser. No. 61/915,942 filed Dec. 13, 2013 the contents of which are hereby incorporated by reference as if recited in full herein for all purposes.

BACKGROUND

The inventive subject matter relates to colorants for fibers, textiles and other substrates. It particularly relates to the application of natural or synthetic colorants to textile surfaces. The inventive subject matter may use plasmas generated in atmospheric pressure systems to facilitate coloration of substrates.

The textile material may be in one of several forms such as fiber, yarn, fabric, garments, etc. Textile colorants are supplied in both solid and liquid forms, for example, as powders, granules, solutions or dispersions. In certain instances, precursors are applied to textile materials to generate the colorant in situ within the textile.

Textile colorants impart color to a textile material, usually with a high degree of permanency, as a result of their chemical binding or physical entrapment within or around the textile material. Both dyes and pigments are used in the coloration of textiles. The former substances are present in solution at some point during their application, whereas pigments remain insoluble within any vehicle in which they are applied as well as within the textile material itself. A dye has an affinity for a textile material and is soluble in a suitable solvent for application to a given substrate. Dyes can penetrate the fiber for dyeing where pigments are fixed to the surface. Dyes are attracted to the fibers because of the chemical interactions between the fibers and the dye. Reactive groups attached to a chromophore (color molecule) provide the capability of the dye to react with the fiber without affecting the color. Bonds can be formed by hydrogen bonds, ionic bonds, or covalent bonds. The complex interactions of and variables in dyeing have been well documented. Areas of variability include substrate, chemicals, preparation of substrate, and procedure variations.

Pigments impart color; however, pigments do not have an inherent affinity for textile material. Where dyes can diffuse into the fiber material, pigments are bonded to the fiber surface. In some cases the name can differ by whether the colorant is suspended or dissolved in the solution.

Current dye techniques for textiles use large amounts of water to apply the dye. The fabric must first be wet to help the dye to penetrate into the fabric. These wet processes also use a large amount of heat and energy to cure and set the dye. After the fabric is removed from the dye, the fabric is then heated to remove the moisture and affix the dye permanently to the fibers in the fabric. It is known that before application of any dyes, fabrics can be pretreated via atmospheric plasma to condition or activate the fabric surface for improved dye pickup during typical wet processing. Color fastness, cure temperature reduction, and wettability/hydrophilicity may each be improved following appropriate atmospheric plasma pretreatment. However, such pretreatments still use and are subject to all the disadvantages of the conventional, water intensive dye-bath procedure. Contributing to the disadvantages of the water-carrier approach, other chemicals must be added to control the pH, alkalinity, and other parameters of the bath.

Traditionally, water has been used as the dyeing medium between fiber and dye interactions. Hydrophilic fibers absorb water (this breaks internal fiber hydrogen bonds, and causes the fiber to swell with water. This allows dyes to migrate into the fiber and bond with the fiber. When the water temperature is increased, fiber swelling increases and better dyeing results with an increase in temperature. Hydrophobic fibers, polyesters and polyamides, do not swell in water. Therefore, the water serves as a medium to transfer small dye particles to be deposited onto the fiber surface. In this case water can serve as a heat transfer medium.

Applying a textile finish commonly involves passing a fabric (woven, knitted, or nonwoven) through a chemical bath, followed by a thermal curing process. In the chemical bath, the fabric collects or absorbs, some of the chemicals in the bath. These chemicals are commonly called "finishes" that include water repellents, anti-microbial, UV protection, and colorants. To assist with the solubility of the chemical finishes in the chemical bath, surfactants and emulsifiers are often added to create uniform suspensions in the bath.

Currently, wet processes used with textiles have several disadvantages. The drying and curing of the treated fabric requires the fabric to be exposed to several minutes at high temperatures. Large ovens and frames may be required to prevent fabric from shrinking, while the high temperatures may alter the drape and stiffen the fabric, or create a dry and rough hand feel. Additives required to solubilize the finish in the bath may penetrate the fabric, leave breakdown products, create a thin film, or remain as impurities. Some impurities may not wash off and result in the removal of the finish during certain home cleaning practices. Because the composition of the chemical bath and pH change over time as the finish is absorbed onto the fabric, the bath must be periodically replaced. This comes at a cost to the chemicals used process as well as the environment, if not properly filtered. Further, dye bath chemistry must be constantly monitored and adjusted. Large amounts of water are used during these finishing processes, as well as energy to cure the fabric at relatively high temperatures. In addition, at each step in the process there is specialized equipment and steps—bath, ovens, cleaning and recycling of baths and water. The required equipment for all the steps occupies a sizeable footprint on the factory floor, adding to the complexity and expense of operations.

Other areas having a need for efficient and simplified construction of end products with multiple properties include bed linens, table linens, upholstery, drapery, tents, awnings, etc.

Accordingly, there is a substantial need for improved textile colorant applications and constructions and manufacturing methods that address the aforementioned needs. These and various other needs are addressed by the inventive subject matter disclosed herein.

SUMMARY

In general, the inventive subject matter relates to methods of treating a substrate, such as a textile to improve substrate properties. In some aspects, the inventive subject matter contemplates providing a substrate having a generally sheet or planar form.

In certain embodiments, the inventive subject matter is directed to a method of treating a substrate, comprising providing a substrate having a generally sheet or planar form or a fiber or yarn form; providing a colorant to be set at the surface of the substrate; and subjecting the substrate and colorant to reactive species from a plasma generated by an atmospheric plasma apparatus until the colorant is set at the surface of the substrate.

In other embodiments, the inventive subject matter is directed to a method of treating a textile, comprising providing a textile; providing a colorant to be set at the surface of the textile; subjecting the textile and/or the colorant to plasma conditions sufficient to set the colorant monomer at the surface; and continuing the conditions until the colorant is set.

In still other embodiments, the inventive subject matter is directed to a method of setting a colorant on a substrate, comprising performing an etch operation on a substrate using a plasma, particularly a plasma generated at atmospheric conditions, to create a desired surface texture at the surface of substrate; and depositing a colorant on the surface under plasma or non-plasma conditions; and allowing the colorant to set at the surface of the substrate.

In yet other embodiments, the inventive subject matter is directed to a construct comprising a substrate material and a colorant set at the surface of the substrate and wherein the substrate comprises a textile material having a generally sheet or planar form and the textile includes an etched surface treatment layer and a complex of colorant and substrate material in the etched layer.

As used herein, "textile" is used in the broadest sense, namely a woven, knit, felted or other woven or non-woven thin sheet of pliable material useful like a fabric or cloth in finished articles such as items of apparel, footwear, and upholstery. The textiles may consist of synthetic fibers, natural fibers, blends, as well as bio-based fiber materials. The textiles may be used in any number of applications, including for casual, business or uniform apparel, home furnishings, furniture or transportation upholstery, hospitality items, such as table linens or napkins, carpets, felts, outdoor furniture, tarps or sunscreens, and any other fibrous items. Fabrics may be flexible, fibrous non-woven substrates, such as paper and paper bandages, disposable apparel or wipes.

The class of plasma processing operations known as "atmospheric plasma" processing is particularly suitable for applying colorants to textiles, according to the inventive subject matter. The plasma operations facilitate novel interactions of dye or other colorant at the surface of a substrate to which the colorant is applied to visibly impart color.

The methods of the inventive subject matter eliminate or substantially reduce the need for water in the entire dye process. The methods also substantially reduce the energy required to heat the fabric to high cure temperatures, as currently required to permanently affix dyes to fabrics. Plasma dyeing does not require large ovens to remove water from the treated substrate. In addition, the solution reservoir for dye solutions will maintain a constant solution and never be diluted—it is easier to add more solution in bulk than to constantly adjust dye bath chemistry as is in the conventional, current processes.

Removing the process inputs of dye baths also frees up large amounts of processing space on the factory floor.

In other embodiments, the inventive subject matter second application technique is directed to application of a dye or other colorant directly to a fabric or other substrate via a pad process. The treated fabric is then subjected to a plasma process to cure the dye and permanently attach the dye to the fabric surface. This method also advantageously will substantially reduce the water and energy consumed relative to conventional, water-based processes.

Collectively, using plasma to apply dye to fabrics or to cure the dye on the fabric will reduce processing times, reduce cost, and provide less strain on the environment. The inventive process includes the application of all colorants and dye types including synthetic and organic dyes and blends of the two onto the surface of all substrates. Substrates include textiles of woven, nonwoven, and knitted fabrics composed of synthetic, natural, and bio-based fibers and any combinations of each. The inventive processes extend to application of colorants to leathers, synthetic leathers, and thermoplastics of the same composition of surface chemistry.

In certain embodiments, the inventive subject matter is directed to a method of treating a textile, comprising: applying a colorant to the substrate by inkjet printing, supercritical $CO_2$ dyeing, or solution dyeing; and subjecting the textile to a reactive species from a plasma generated by an atmospheric plasma apparatus until the colorant is set at the surface of the substrate.

These and other embodiments are described in the following detailed descriptions and the figures.

The foregoing is not intended to be an exhaustive list of embodiments and features of the inventive subject matter. Persons skilled in the art are capable of appreciating other embodiments and features from the following detailed description in conjunction with the drawings.

The following is a description of various inventive lines under the inventive subject matter. The appended claims, as originally filed in this document, or as subsequently amended, are hereby incorporated into this Summary section as if written directly in.

BRIEF DESCRIPTION OF THE DRAWINGS

The following figures show embodiments according to the inventive subject matter, unless noted as showing prior art.

DETAILED DESCRIPTION

Overview

Figure 1:
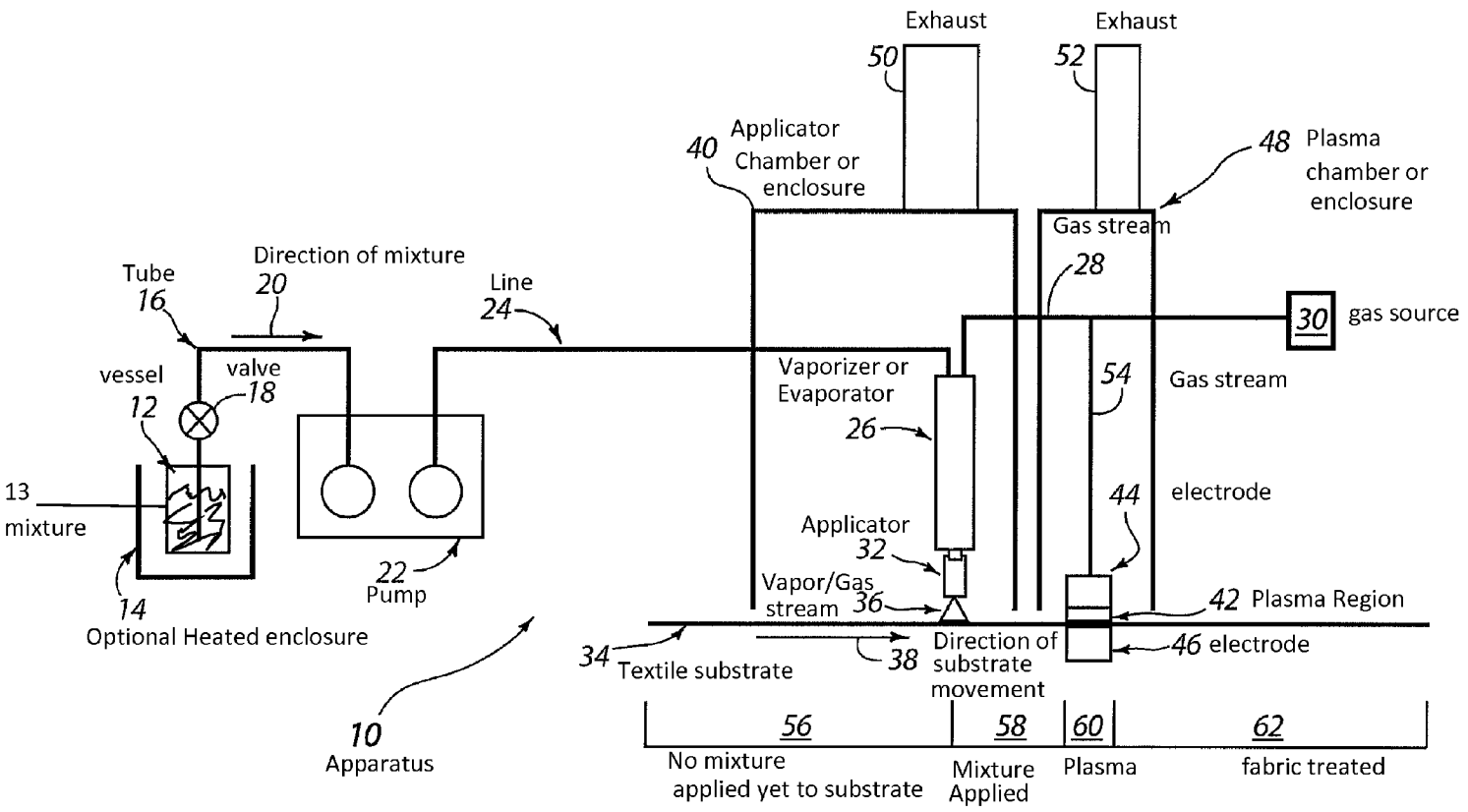
FIG. 1 is a schematic representation of a prior art apparatus that may be adapted for use in a method according to the inventive subject matter of treating substrates with a colorant under a plasma operation.

Persons skilled in the art will recognize that many modifications and variations are possible in the details, materials, and arrangements of the parts and actions which have been described and illustrated in order to explain the nature of the inventive subject matter, and that such modifications and variations do not depart from the spirit and scope of the teachings and claims contained therein.

In some of its possible embodiments, the inventive subject matter is generally directed to the application of colorants to the surfaces of substrate materials to impart desired colors and colorways (i.e., combinations of two or more different colors) to the substrates. By "application to the surface," it is generally meant that the colorant is applied as deposited material that ultimately binds, or otherwise is fixed at, or entrapped in, the surface material of the substrate sufficiently to promote the appearance of a desired color at the substrate surface that is attributable at least in part to the colorant. The fixing of the colorant in a permanent or semi-permanent manner (i.e., capable of staying substantially fixed through repeated instances of normal use and laundering of the colored item) may be referred to herein as the "setting" of the colorant. The setting of a colorant at the surface of a substrate means on the surface and/or at a deeper level below the surface but with a sufficient surface visibility to impart desired color characteristics.

While much of the following description may apply to all types of colorants, dyes will be used as a primary example of a colorant to illustrate the inventive subject matter and principles of operation.

The substrates specifically contemplated under the inventive subject matter include textiles. The textiles are not limited to any particular type. As used herein, "textile" is used in the broadest sense, namely a woven, knit, felted or other woven or non-woven thin sheet of pliable material useful like a fabric or cloth in finished articles such as items of apparel, footwear, and upholstery. The textiles may consist of synthetic fibers (usually petroleum based), natural fibers, blends, as well as bio-based fiber materials.

In some of its possible embodiments, the inventive subject matter relates to coloration of woven and non-woven textiles as substrates (which may also be referred to herein as "substrates") in a plasma processing operation. The class of plasma processing operations known as "atmospheric plasma" processing is particularly suitable for creating such modifications. Modifications of textiles in the nature of applying colorants to textile surfaces are particularly contemplated by the inventive subject matter.

Current textile wet processes are energy and resource intensive. Textile processes such as dyeing, applying water or stain repellency, and other surface treatments require large amounts of water and large amounts of energy for drying, and maintaining cure temperatures. The wet-dyeing equipment also has large footprint on the factory floor. Accordingly, there is a need for improved textile processes that use little or no water. There is a need also a need for such processes to require less energy and space, and fewer chemicals and byproducts. By selecting plasma conditions that modify the surface of a substrate with respect to varying hydrophobicity/hydrophilicity, plasma processing may be used to impart characteristics such as dyeability and/or water and stain repellency. For example, dyes that are predominantly hydrophobic would bond better with a substrate surface that has been modified to be more hydrophobic.

Plasma technology has been around since at least the 1960s. Plasma is generally considered a gaseous phase of matter characterized by excited species such ions, free electrons, and an amount of visible, UV and IR radiant energy. The plasma state can be generated by electrical energy, nuclear energy, thermal energy, mechanical energy and/or radiant energy. Plasmas may be characterized by charged particle density, temperature, pressure and the presence/absence of electrical and/or magnetic fields. Plasma is generally classified as thermal or non-thermal. In thermal plasma, temperature of several thousand degrees is reached, which is destructive of textiles and other common materials. Non-thermal plasmas may be referred to as "cold" plasmas because they may be maintained at low temperatures such as between 0-100 degrees Celsius range. There are two types of cold plasma that can be used in textile applications: low pressure, i.e., sub-atmospheric (approximately 1-100 pa), and atmospheric (ambient) pressure.

Atmospheric plasma is available in a number of different forms: corona treatment, dielectric barrier discharge, hybrid combinations, and atmospheric glow discharge. One disadvantage of low-pressure plasma treatments is that they are performed in a contained vessel, under vacuum. Therefore, they are limited to batch processing of textiles, not continuous processing. For the speed of processing textiles in a roll-to-roll process for large volumes, batch processing is not efficient. On the other hand, with recent advances in atmospheric plasma treatments, the possibility now exists for continuous processing of textiles. Because atmospheric plasma can be a roll-to-roll process and can mimic high temperature reactions at room temperature, it promises to be an ideal process to use for the modification of textiles.

Textiles often have limitations to high cure and process temperatures. Although many parameters influence the plasma treatment (plasma gas type, residence time, gas flow, frequency, power, pressure, ambient temperature, liquid monomers, gases), the process is a more energy efficient and environmentally friendly. The downside of conventional, high-temperature plasma processes is that the surface modification and molecular modification are limited by the aggressive nature of the plasma. The plasma destroys the molecular chains of the molecule injected into the plasma and fragments the material. Atmospheric plasma provides sufficient energy to create a coating that maintains the spaces between the yarns, withstands multiple home launderings, maintains the integrity of the fabric, and does not affect the air permeability of the fabric. The spaces between fibers in a woven fabric are on the order of 100 nm, and a film thickness of 70 nm would have negligible effect on the fabric breathability.

The ionized species in plasma can occur when a voltage is placed across the gas. Radicals present in the plasma react with the surface of a substrate and/or with other species in the plasma. Plasma reactions can transform substrate surfaces in various ways. The species and energy in the plasma may be used to etch or clean a substrate surface. The plasma may enable may cause various forms of substrate surface activation. For example, the plasma conditions may cause breaking of chemical bonds; grafting of chemical moieties and functional groups, volatilizing of surface materials and removal (etching), dissociating of surface contaminants/layers (cleaning/scouring), and depositing of conformal coatings. In all these processes a highly surface specific region of the textile material (e.g., <1000 A) is given new, desirable properties without negatively affecting the bulk properties of the constituent fibers or other constituent material. To illustrate a few textile applications, surfaces may be roughened or smoothed. They may be made more hydrophobic or more hydrophilic. Chemical modification of the surface can occur by the attachment of functional groups to the substrate surface. Plasma polymerization of thin films is also an option. During the plasma process, monomers or polymers can be linked together or polymerize at the substrate surface and provide thin films of various surface and technical performance alterations. Pre-treatment and surface modification can be accomplished using only the plasma gas/substrate interaction. To apply thin films and functional groups, for instance, small amounts of the chemicals are injected via a syringe, or mist, into the plasma cloud, or as a mist onto the substrate surface where the substrate then immediately passes under the plasma cloud. Certain gas plasmas are used for certain effects: Argon—surface roughness modifications; Oxygen—surface and surface energy modifications; ammonia and carbon dioxide—surface chemical reactivity modifications. Using an inert gas plasma of helium is particularly suitable for monomers that polymerize via free radical reactions. An inert gas is able to trigger polymerization without chemically altering the polymer coating created. Additions of the aforementioned reactive gases ($H_2$, $N_2$, $NH_3$) can alter the performance and composition of the resulting polymer. These blends can induce condensation reactions or cross-linking of polymer chains. For example, the addition of $H_2$ could result in the condensation of a monomer via the loss of an OH group by way of a condensation reaction. Additionally, to increase the durability of the monomers, additions of $N_2$ and $NH_3$ may induce crosslinking of polymer chains. Proposed pathways of plasma-induced polymerization reactions induced between monomer-fabric or monomer-monomer polymerization have been documented in literature. Plasma treatment has been studied by others for the application of a water repellent and a secondary finish. A water repellent has been combined with a flame retardant. The flame retardant and water repellent monomers were mixed in a bath and applied to the substrate. The finishes were then cured simultaneously using atmospheric glow discharge plasma. This research shows application promise to include secondary finishes of water repellents, antimicrobials, flame retardants, dye chemistry, etc. in the feed with protein monomers. Therefore, the addition of one or more secondary functional finishes may be included in the dye or other colorant feedstock or in a separately applied feedstock. For example, secondary finishes in a different feedstock may be added via additional passes through the atmospheric plasma.

The following is one possible embodiment for the application of colorants to textile substrates, and subsequently optional secondary finishes. In a first step pre-application step, a substrate, for example, a fabric is subjected to plasma pre-treatment that activates the fabric surface. In a second step, a colorant, such as a dye or pigment is applied to the activated surface of the fabric in vapor form (or via a padding addition).

In a third step, the fabric surface with the applied colorant is subjected to a second plasma exposure. This multi-step process may be used to optimize the colorant composition, e.g., a dye feedstock solution composition, and plasma parameters, such as flow rate, etc., to the one-step process of passing the fabric through the plasma-dye mix and allowing the deposition, binding the dye onto the fabric in a one-step plasma treatment step. Additionally, secondary finishes optionally can be added to the fabric and feedstock solution under these processes.

Plasma conditions are at about room temperature and at about atmospheric pressure. The dyes contemplated hereunder may be injected into a plasma chamber as a liquid spray or vapor or atomized particles and are expected to hold up to the plasma process conditions. When plasma is created, through a voltage addition, it creates active species, which collide with the textile surface. For the textile, plasma usually reacts with the carbon or heteroatoms of the substrate and can form active free radical functional groups. When a colorant such as dye molecules is injected into the plasma, it should bind and cure onto the active surface groups of the substrate via chemical bonding.

For fabric and like substrates, because atmospheric plasma is at about room conditions, it is not necessary to pre-condition the fabric to humidity of the air. In some possible embodiments, the general process involves moving the fabric into the plasma chamber and subjecting the fabric to dyes at atmospheric pressure, followed by rapid setting of the dye on the fabric surface by the plasma to achieve a uniform coating that does not affect the drape or breathability of the fabric. The amount of dye deposited (and/or set) may depend on the flow rate of the dye and the staged speed or residence time in the chamber under plasma conditions. Changes in the time spent in the chamber under plasma conditions can increase the saturation of the colorant at the surface of the substrate. Furthermore, the process can be repeated numerous times to increase the concentration of colorant to impart the desired color properties without affecting the drape or stiffness of the fabric.

Generally, plasma may create short-lived activated species on the substrate surface. Because atmospheric plasma operations use free-radical chemistry at room temperature, dyes are expected to remain stable in plasma operations. However, it is possible that the colorants themselves may become activated in the plasma. For example, if both a dye and a fabric substrate are activated by plasma, the free radicals from each material could bind with each other. If the activation of the dyes becomes problematic or destroys the dye material, it would be possible to alter the feed gas to specify the radical formation. Another possibility is to deposit the dyes and to use active species from the plasma as agents that bond the dye molecules and substrate together.

In short, the electric field of the plasma or active species generated by the electric field of the plasma apparatus could generate specific active groups and form active groups selectively on the dye dispersed in the plasma or on the substrate in communication with the plasma or active species of the plasma. The plasma may be used to create active species, such as hydroxyls, amines, peroxides, on the dye molecules and/or on the surfaces of the substrates.

While atmospheric pressure plasmas typically use helium (e.g., for polymer deposition) as the carrier gas, others gases or blends can be used. However, helium is a small atom that can lack vibrational, electronic, and rotational energy levels sufficient to cause high ionization. Other gases may be used as a carrier gas in creating relatively high-energy plasmas. Such gases include ambient air, nitrogen, oxygen, argon, and any combination of these gases. These other carrier gases require relatively higher voltages, and might damage to textile substrates, so gases and process conditions will be selected accordingly.

Dye Classes, Mechanisms, and Applications

In some embodiments, the inventive subject matter is directed to methods of applying colorants, such as dyes onto or into the surface of a textile material or other substrate so that colorant visibly imparts color to the surface.

Most classes of dye are expected to hold up under plasma conditions and form into reactive plasma species. Under plasma, most dyes classes are expected to be energetic enough to be made into active species without degradation. Alternatively or additionally, the substrate surface will be subjected to plasma and become activated by the plasma, and the dye, in a form activated or not activated by the plasma, will be cured on the substrate in the plasma.

Dye chemistry may be classified by the chemical makeup and the application of the dye to specific fibers. For example various chemistries are classified under acid dyes, basic dyes, disperse dyes, direct or substantive, mordant and chrome, pigment, organic, solvent, azoic, sulfur, acetate rayon dyes, nylon dyes, cellulose acetate dyes, and vat dyes. For cellulose fibers these application methods include: direct dyes, sulfur dyes, azoic dyes, reactive dyes, and vat dyes. Protein and synthetic fibers use application methods of acid dyes, basic dyes, and disperse dyes. Dyes used for each application are further classified into 13 groups according to their chemical structure: azo dyes, anthraquinone dyes, benzodifuranone dyes, polycyclic aromatic carbonyl dyes, indigoid dyes, polymethine and related dyes, styryl dyes, di- and tri-aryl carbonium dyes, phthalocyanine dyes, quinophthalone dyes, sulfur dyes, nitro and nitroso dyes, and miscellaneous dyes.

Acid dyes contain acidic reactive groups: —$SO_3H$, and are applicable to fibers that contain basic groups such as free amino groups: —$NH_2$. Wool consists of keratin, a protein. The fiber includes the amino acid proline and 18 alpha-amino acids. Some of the amino acids contain acid and basic groups. The main dye absorption site is the amino acid groups. Because wool is amphoteric it can absorb acid or basic dyes. Nylon also has amino groups; however, the number of these end groups depends on how the fiber was manufactured and the molecular weight. Nylon is a thermoplastic polymer and the rate of dyeing is affected by the temperature and pH of the dye bath. Basic dyes (cationic) are applicable on fibers that contain acid groups. These fibers contain carboxyl, —COOH, or sulfonic acid, —$SO_3H$, groups.

Disperse dyes are almost insoluble in water. These can be applied to nylon, cellulose acetate, and other fibers. However, disperse dyes are typically applied to hydrophobic fibers such as polyesters. Dispersing agents are used in the dye bath to help disperse the insoluble dye and increase the rate of dye absorption. Carriers can also help increase the affinity for polyester, as well as altering the size of the dye molecule to increase the diffusion. These changes also can alter the dye fastness on the fiber. For example, high water temperature dye baths (e.g., around 140° C.) can help larger dye molecules diffuse into the fiber. This thermal method helps provide better colorfastness.

Due to low surface energy, polypropylene is hydrophobic. Polypropylene has weak hydrophilicity and not reactive to cationic dyes. Pretreating polypropylene with oxygen plasma may incorporate oxygen in the form of C—O and O—H sites on the material's surface. These sites increase the dye uptake of polypropylene from cationic (basic) dyes. Similarly, pre-treating the fabric using a nitrogen gas may create N—H groups on the material's surface, increasing the dye exhaustion from direct (anionic dyes). Pretreatment of a wool/polyester blend in a plasma of nitrogen and air plasma may induce NH2 groups, resulting in an increase uptake of anionic dyes (acid dyes). Using an oxygen/nitrogen/and air gas plasma pretreatment, the wool/polyester blends may show an increase in basic dye uptake by the formation of reactive COO— and OH— groups.

Successful application of colorants to fibers is dependent on the affinity of a given colorant to a given substrate. Because of this, the colorants are modified to specifically bind to the charge of the fiber with a greater affinity to the fiber than to the carrier solution that the colorant is suspended or dissolved within. Each colorant has a complementary molecular design to bond with a given fiber. Selecting or designing the colorant molecule takes into account many factors, including affinity to the substrate, the durability to wash, UV resistance, and other parameters required for each specific product end use. While the below is a basic summary, it is known that many dye mechanisms can be modified to bond with fibers not listed below. Additional chemicals can be added to dye solutions to alter reactions allowing, for example, acid dyes to dye what is normally basic dyed fibers, and basic dyes to dye what is normally acid dyed fibers, etc. Below is a basic outline of dye mechanisms and how a plasma process can take the place of current dye processes using water as a carrier.

Polyester:

Disperse dyes may be used for dying polyester. Disperse dyes are designed to be hydrophobic in nature. This way the dyes are easily absorbed onto hydrophobic surfaces of polyester (i.e., like dissolves like). These dyes will not normally work for hydrophilic polymers such as Cellulose (cotton). Below is a structure of three basic disperse dyes. These dyes are typically azo, compounds with R—N═N—R' groups or anthraquinone compounds with the general formula $C_{14}H_8O_2$.

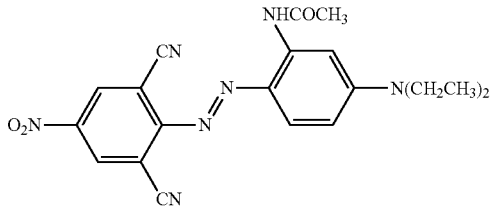

Disperse Blue 165

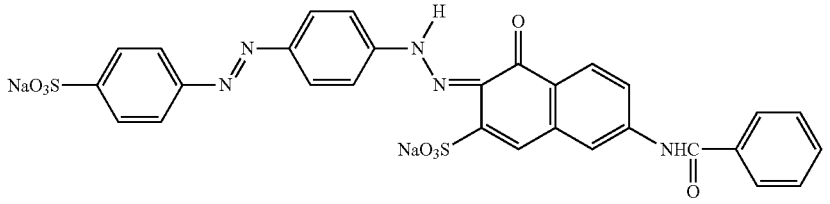

Direct Red 81

-continued

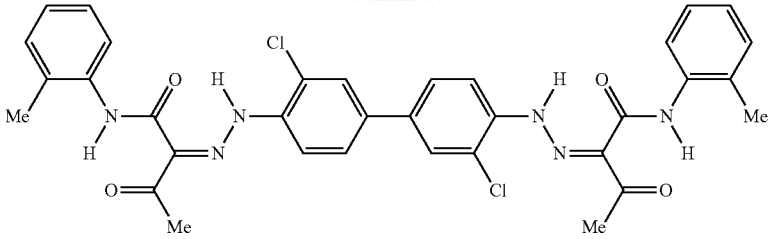

Pigment Yellow 14

Nylons and Proteins

Dyes used for nylon and protein fibers normally form ionic bonds within the polymers of the fiber. Ionic bonds are bonds between two ions with opposite charges. Nylon, wool, and other protein based polymer fibers carry a positive charge (known as being cationic). Therefore, dyes must carry a negative charge to be attracted to and bind with the positive charge of the molecules on the fiber and vice versa. Dyes for these fibers are known as acid dyes. Acid dyes cannot normally bond with cellulose substrates because the dyes cannot form strong ionic bonds with them. This charge-dependent bonding process is shown in the diagram below. This bond is similar to the bond in table salt. Below is schematic dye mechanism for the charge-dependent bonding process of dye on nylon.

$$\text{Dye-SO}_3^{\ominus}\text{Na}^{\oplus}+\text{Nylon-NH}_3^{\oplus}\text{Cl}^{\ominus}\rightarrow\text{Dye-SO}_3^{\ominus\oplus}\text{H}_3\text{N-Nylon}$$

Below are basic chemical formulas for an acid black dye, and a basic red dye.

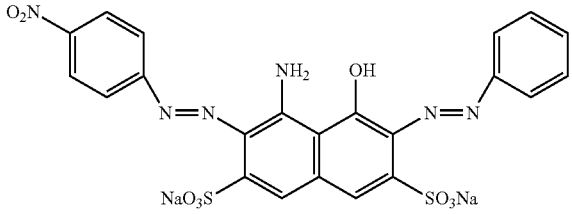

Acid Black 1

-continued

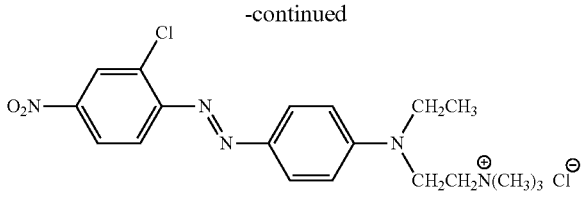

Basic Red 18

Basic dyes bond to polymer backbones of fibers that have a negative charge. Polyester will not form ionic bonds with a positively charged basic dye because the charges repel. However, wool and silk each have carboxylate groups (—$CO_2$). This carboxyl group carries a negative charge that will form an ionic bond with a positively charged dye molecule.

Cellulose Fibers

Cellulosic fibers such as: cotton, rayon, and linen are hydrophilic. Contrary to polyester fibers, which are hydrophobic, cellulose dyes are normally required to be hydrophilic (like attracts like). Neither cellulose nor polyester fibers have strongly charged molecules that can form ionic bonds with dye molecules. Instead, the affinity of the dye to the fiber is determined by electrostatic forces known as hydrogen bonding. This is a strong force where molecules possess partial charges (dipole moments) created by the atoms contained within them. These charges interact with the oppositely charge dipole of adjacent molecules. This bond is an attractive force only and the molecules do not share electrons. Below is an example a cellulose fiber (A) hydrogen boding to a direct dye (B).

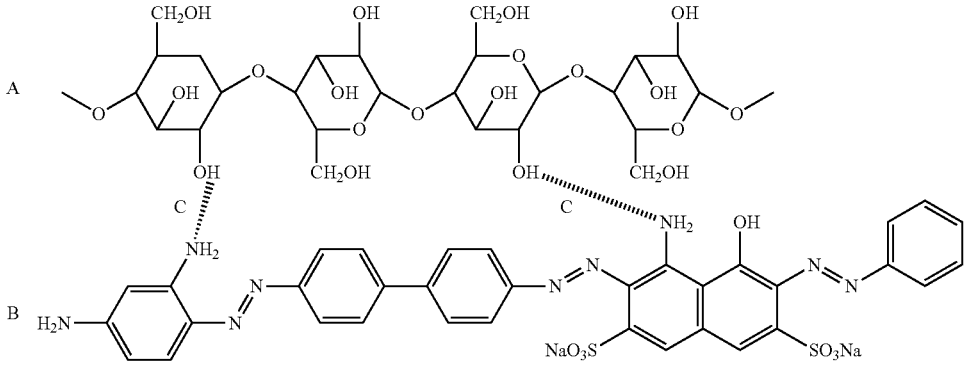

Dye classes for cellulose fibers include azoic, vat, sulfur, direct, and reactive dyes. Each of these dyes must normally be water soluble. Because the dye molecules can form hydrogen bonds, they are solubilized in water. Water has dipole moments and is partially charged. Because of this, water can form and break hydrogen bonds. Therefore, water is a good solvent for many chemicals and can surround dye molecules, thus suspending the dye molecules in solution. Hydrogen bonds on the dye molecules are then directed to the fiber as the water is evaporated.

Current research has shown that applying cationic reagents to cotton can change the charge on cotton from negative to positive. This increases the affinity of anionic dyes. Currently, cationic reagents are applied to ginned cotton in bale form and then blended with untreated cotton at the yarn mill to create a yarn where the treated cotton can be dyed without the use of electrolyte (salt) or base (soda ash) and at cold to warm temperatures. The current batch process is expensive and is only used in novel yarns (e.g., overdye heathers, etc.). By commercializing this process using atmospheric plasma, the potential exists to have a very large impact on both the cost and environmental aspects of dyeing cotton. (Reference: Cotton Incorporated Technical Bulletin: "Dyeing Cationic Pretreated Cotton TRI 3016). According to the inventive subject matter, spraying dye on cationic cotton substrates that use cationic treated cotton yarns, and yarns at different levels of cationic treatment, and curing in plasma can help reduce the water and heat required. Another advantage is that the novel process should also provide better shade distribution and depths of dyeing.

To increase colorfastness (prevent dyes from washing out) vat dyes, sulfur dyes, and reactive dyes were created. Each has a unique process outlined elsewhere. Reactive dyes have been modified to form covalent bonds with fibers. Covalent bonds are a balanced bond where electron pairs are shared. Below are generic structures for a sulfur dye (a), vat dye (b), azoic dye (c), and a reactive dye (d).

a

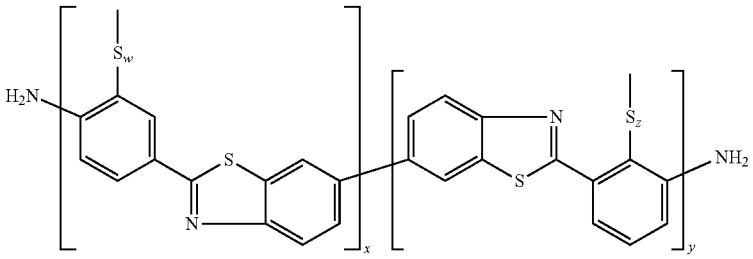

b

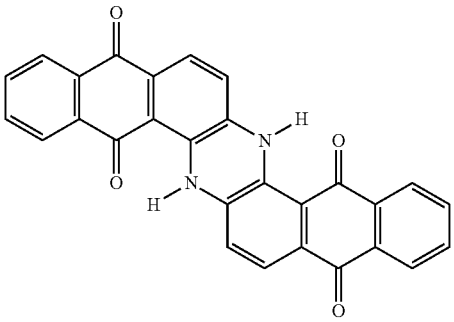

c

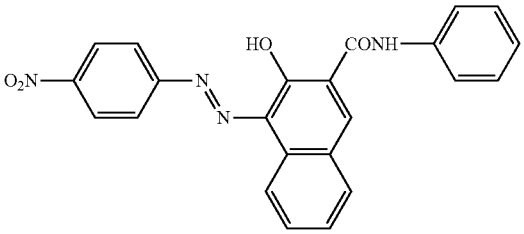

d

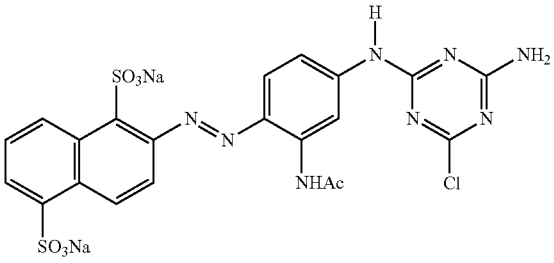

Each group of dyes has vital substituent that allows the dye to be soluble in water or bind with a hydrophobic/hydrophilic surface.

Plasma can assist with the foregoing dye-substrate interactions. Previously water was the carrier fluid to allow dye molecules to be solubilized by hydrogen bonding or dispersed to prevent clumping of dye molecules. In the case of plasma, the interaction of the plasma feed can modify the fiber surfaces to be more hydrophilic and hydrophobic. When plasma creates a surface charge on the fibers this creates an affinity for the dye molecules to bind via hydrogen bonding, ionic bonding, or covalent bonding. When dye is injected as a fine mist onto the substrate, or into the plasma, the dye molecules in the plasma cloud, or on the substrate surface, will have uniform distribution. The dyeing process is an interaction of each dye molecule and a site on a fiber. Therefore, each bond can be viewed as individual event, similar to a dye bath and the amount of dye molecules sprayed on the substrate, or directly into a plasma cloud will be efficient for dyeing the substrate. Therefore, if using a plasma dyeing process, water is not needed to conduct the majority of the dye operations. Following the addition of dye to fabric, the fabric requires a thermal cure to remove the excess water from the fiber. Removing the excess water allows the dye molecules to adhere only to the polymer chains. However, a plasma process does not use any water. Therefore, thermal curing is not required. In addition, plasma reactions can mimic high-temperature reactions. Therefore, if any energy is required to overcome bond energies to set or permanently fix the dye on the substrate, the plasma energy will suffice.

In addition, the basic chemical structure within each dye type is similar in the regard that it has the same basic structure that will bond to a specific fiber. The similarities between the charges of different fibers have been outlined herein. Therefore, within accuracy the bonding results of dyes will be similar in any medium, water or plasma, because the reactions and bonds are similar.

For example, the two tables below show disperse dye structures based on Anthraquinones and Aminoazobenzene. The substituents R1-R7 control the characteristic s of the disperse dye product, color, colorfastness, and dyeing properties. Many dyes using water require a dye bath that balances many parameters; ph, alkalinity, and temperature to name a few. Because plasma does not use water, it is believed that plasma can reduce the need for many chemicals and directly activate and attach the colorants to the fibers.

TABLE 15.2

Disperse Dye Structures Based on Anthraquinone

| Dye # | C.I. Disperse Dye Name | $R_1$[a] | $R_2$ | $R_3$ | $R_4$ | $R_5$ | $R_6$ |
|---|---|---|---|---|---|---|---|
| 1 | Orange[b] | OH | H | H | OH | H | H |
| 2 | Red 15 | $NH_2$ | H | H | OH | H | H |
| 3 | Red 9 | $NHCH_3$ | H | H | H | H | H |
| 4 | Red 60 | $NH_2$ | OAr | H | OH | H | H |
| 5 | Violet 1 | $NH_2$ | H | H | $NH_2$ | H | H |
| 6 | Blue 1 | $NH_2$ | H | H | $NH_2$ | $NH_2$ | $NH_2$ |
| 7 | Blue 14 | $NHCH_3$ | H | H | $NHCH_3$ | H | H |
| 8 | Blue 3 | $NHCH_3$ | H | H | $NHC_2H_4OH$ | H | H |
| 9 | Blue 24 | $NHCH_3$ | H | H | NHAr | H | H |
| 10 | Blue 27 | OH | H | H | NHArEtOH | $NO_2$ | OH |
| 11 | Blue 56 | OH | $Br_n$[c] | H | $NH_2$ | OH | $NH_2$ |
| 12 | Blue 73 | OH | ArOMe | H | $NH_2$ | OH | $NH_2$ |
| 13 | Blue 60 | $NH_2$ | CO—N(R)—CO[d] | | $NH_2$ | H | H |

[a]See FIG. 15.2 for positions of R groups.
[b]The orange intermediate Quinizarin.
[c]$Br_n$. The positions and number of bromo groups is uncertain.
[d]This group bridges the $R_2$—$R_3$ positions and R is $C_3H_6OCH_3$.

TABLE 15.1

Disperse Dye Structures Based on Aminoazobenzene

| Dye # | C.I. Disperse Dye Name | $R_1$[a] | $R_2$ | $R_3$ | $R_4$ | $R_5$ | $R_6$ | $R_7$ |
|---|---|---|---|---|---|---|---|---|
| 1 | Yellow[b] | H | H | H | H | H | H | H |
| 2 | Orange 3 | $NO_2$ | H | H | H | H | H | H |
| 3 | Orange 30 | $NO_2$ | Cl | Cl | H | H | $C_2H_4CN$ | $C_2H_4OAc$[c] |
| 4 | Red 1 | $NO_2$ | H | H | H | H | $C_2H_5$ | $C_2H_4OH$ |
| 5 | Red 13 | $NO_2$ | Cl | H | H | H | $C_2H_5$ | $C_2H_4OH$ |
| 6 | Red 195 | $NO_2$ | $SO_2CH_3$ | H | H | $CH_3$ | $C_2H_4OAc$ | $C_2H_4OAc$ |
| 7 | Violet 12 | $O_2$ | $NO_2$ | H | H | H | $C_4H_9$ | $C_2H_4OH$ |
| 8 | Violet 33 | $NO_2$ | OH | H | H | $CH_3$ | $C_2H_4OAc$ | $C_2H_4OAc$ |
| 9 | Blue 79 | $NO_2$ | $NO_2$ | Br | $OC_2H_5$ | NHAc | $C_2H_4OAc$ | $C_2H_4OAc$ |
| 10 | Yellow 3 | AcNH | H | H | $CH_3$ | OH | —[d] | — |

[a]See FIG. 15.1 for position of R groups.
[b]C.I. Solvent Yellow 1.
[c]Ac = acetyl (—$COCH_3$).
[d]No —$N(R_6)R_7$ group: just H.

1. http://monographs.iarc.fr/ENG/Monographs/vol99/mono99-7.pdf
2. J. R. Aspland, Textile Dyeing and Coloration, American Association For Textile Chemists and Colorists In the context of the inventive subject matter, a coloration reaction using dyes also allows the attachment of secondary finish molecules to natural and synthetic materials to produce coated materials tailored for specific applications, e.g., colored clothing and textiles for footwear having highly active surfaces providing UV-blocking, antimicrobial, and/or self-cleaning properties. The coatings may be doped to provide electrical conductivity to the coating or selected portions thereof. One example of a doping agent is iodine as well as various conductive metals. By selected doping, conductive circuits or traces may be formed in the coating for use electronics and in computing or wireless applications, such as are emerging in the area of "smart clothing".

Plasma Processing

Plasma is generally considered a gaseous phase of matter characterized by excited species such ions, free electrons, and an amount of visible, UV and IR radiant energy. The plasma state can be generated by electrical energy, nuclear energy, thermal energy, mechanical energy and/or radiant energy. Plasmas may be characterized by charged particle density, temperature, pressure and the presence/absence of electrical and/or magnetic fields. Plasma is generally classified as thermal or non-thermal. In thermal plasma, temperature of several thousand degrees is reached, which is destructive of textiles and other common materials. Non-thermal plasmas may be referred to as "cold" plasmas because they may be maintained at low temperatures such as between 0-100 degrees Celsius range. There are two types of cold plasma operations that can be used in textile applications: low pressure, i.e., sub-atmospheric (approximately 1-100 pa), and atmospheric (ambient) pressure.

Atmospheric plasma is available in a number of different forms: corona treatment, dielectric barrier discharge, hybrid combinations, and atmospheric glow discharge. One disadvantage of low-pressure plasma treatments is that they are performed in a contained vessel, under vacuum. Therefore, they are limited to batch processing of textiles, not continuous processing. For the speed of processing textiles in a roll-to-roll process for large volumes, batch processing is not efficient. On the other hand, with recent advances in atmospheric plasma treatments, the possibility now exists for continuous processing of textiles. Because atmospheric plasma can be a roll-to-roll process, can mimic high temperature reactions at room temperature, and requires little or no water, it is a novel, advantageous process to use for the modification of textiles.

The ionized species in plasma are generated when a voltage is placed across a gas. Radicals present in the plasma react with the surface of a substrate and/or with other species in the plasma. Plasma reactions can transform substrate surfaces in various ways. The species and energy in the plasma may be used to etch or clean a substrate surface. The plasma may enable may cause various forms of substrate surface activation. For example, the plasma conditions may cause breaking of chemical bonds; grafting of chemical moieties and functional groups, volatilizing of surface materials and removal (etching), dissociating of surface contaminants/layers (cleaning/scouring), and depositing of conformal coatings. In all these processes a highly surface specific region of the textile material (e.g., <1000 A) is given new, desirable properties without negatively affecting the bulk properties of the constituent fibers or other constituent material. To illustrate a few textile applications, surfaces may be roughened or smoothed. They may be made more hydrophobic or more hydrophilic. Chemical modification of the surface can occur by the attachment of functional groups to the substrate surface. Plasma polymerization of thin films is also an option. During the plasma process, monomers or polymers can be linked together or polymerize at the substrate surface and provide thin films of various surface and technical performance alterations. Pre-treatment and surface modification can be accomplished using only the plasma gas/substrate interaction. To apply thin films and functional groups, for instance, small amounts of the chemicals are injected via a syringe, or mist, into the plasma cloud. Certain gas plasmas are used for certain effects: argon—surface roughness modifications; oxygen—surface and surface energy modifications; Ammonia and carbon dioxide—surface chemical reactivity modifications.

Different feed gases can create different reactive species on the surface of the textile that will react or interact with colorant molecules. For example, the formation of certain reactive species can increase the wettability and diffusion of different water and dye molecules into a fiber and onto the fiber surface. While pre-treatment of fabrics with atmospheric plasma has been used to improve the dying process. The inventive subject matter in certain embodiments is directed to novel approaches of using (2) atmospheric plasma to directly apply the dye or other colorant to the fabric surface as, well as imparting dye molecules of certain molecular weight into the fiber and curing the colorants. This creates a permanent, wash durable color on and within the fiber without affecting the drape or soft hand of the fabric surface.

Plasma treatments are dry processes that do not require any significant amount of water (other than, for example, the dye feedstock in which the dye or other colorant solubilized or dispersed). Atmospheric plasma uses little energy, and does not require heat to cure. Plasma can alter the surface properties of a textile and consequently the dyeability. This changes or creates, for example, hydrophilic/hydrophobic sites on a textile. It can also create free radicals on the fiber surface that can react or interact with the colorant molecules. If a plasma etching process is used, then it can open pores in the fibers to allow dye molecules to penetrate deeper into the textile for better fastness.

Figure 2:
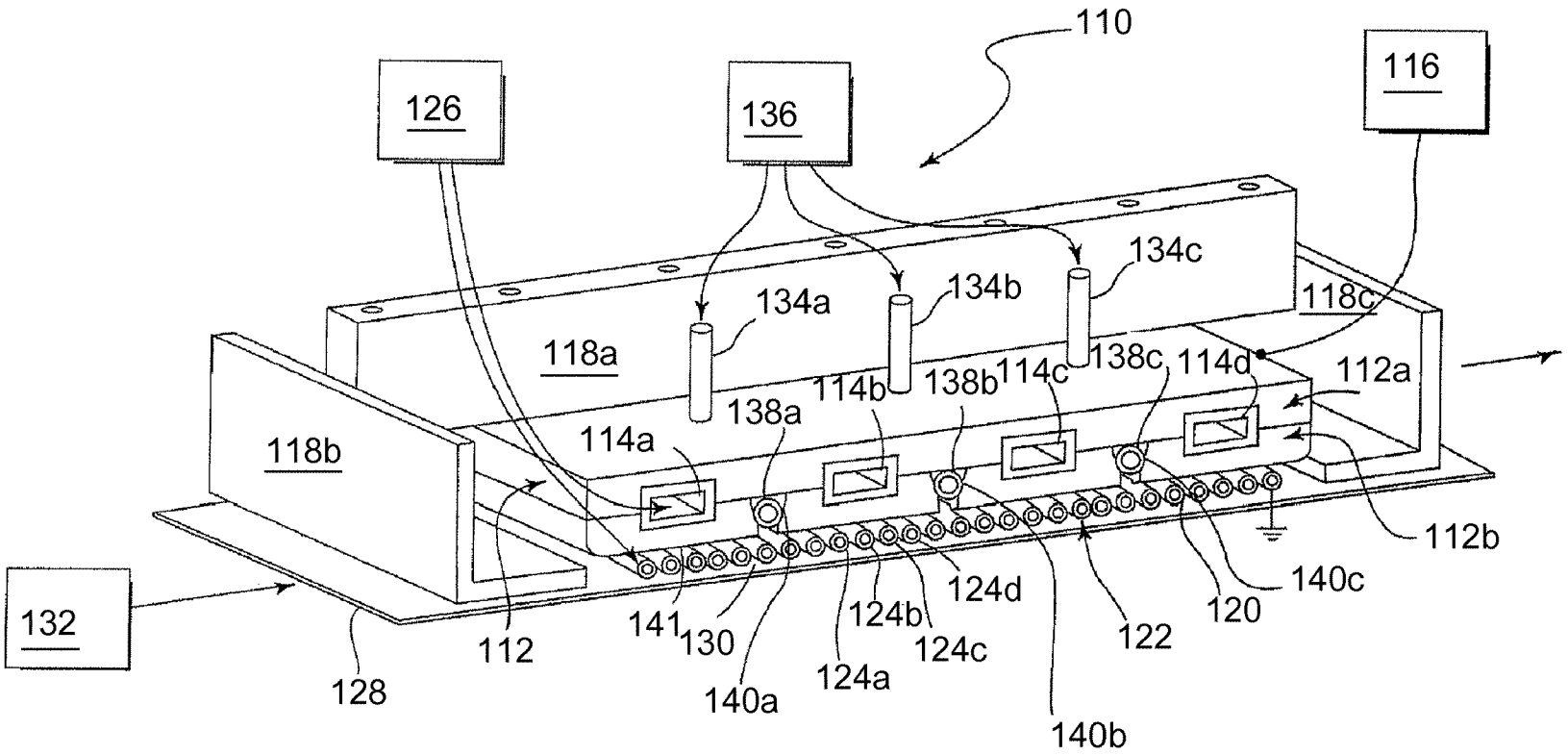
FIG. 2 is a perspective view of another possible embodiment of a prior art apparatus that may be adapted for used in a method according to the inventive subject matter of treating substrate with a colorant under a plasma operation.
Figure 3:
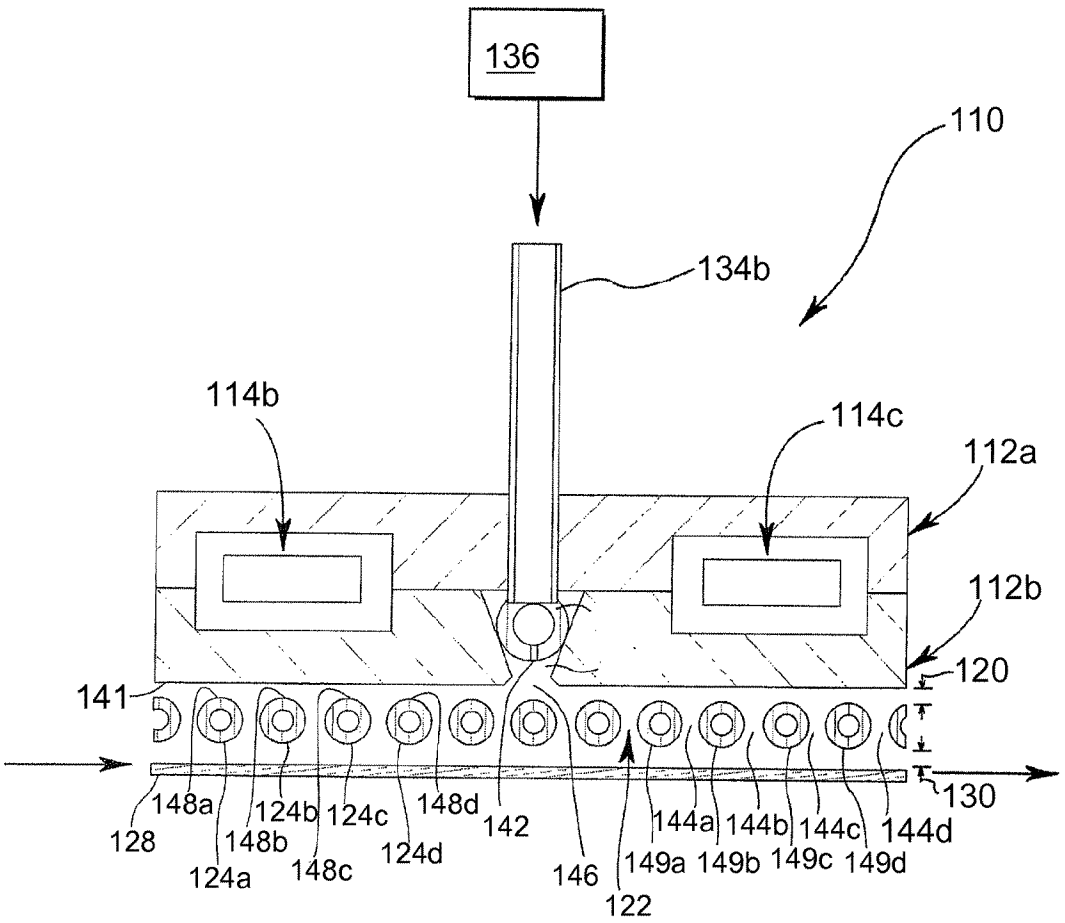
FIG. 3 is a representation of a side view of the plasma processing apparatus shown in FIG. 2.

US Patent Publication 20080107822 is directed to treatments of fibrous materials using atmospheric pressure plasma polymerization and is hereby incorporated by reference in its entirety for all purposes consistent with the teachings herein. The disclosed systems and methods may be adapted for use in applying colorants to textiles. FIGS. 2-3, consistent with the '822 patent publication and as discussed in more detail below, show an example of a suitable system.

U.S. Pat. No. 8,361,276 discloses methods and systems for large area, atmospheric pressure plasma for downstream processing and is hereby incorporated by reference in its entirety for all purposes consistent with the teachings herein. The systems and methods in that patent may be adapted for use in applying colorants to textiles. FIGS. 2-3, consistent with that patent and as discussed in more detail below, show an example of a suitable system. It may include an arcless, atmospheric-pressure plasma generating apparatus capable of producing a large-area, temperature-controlled, stable discharge at power densities between about 0.1 $W/cm^3$ and about 200 $W/cm^3$, while having an operating gas temperature of less than 50 degrees Celsius. The apparatus produces active chemical species (which may also be referred to herein as "reactive species"). The reactive species may include gaseous metastables and radicals. Such species may be used for polymerization (e.g., free radical-induced or through dehydrogenation-based polymerization), surface cleaning and modification, etching, adhesion promotion, and sterilization, as examples. The system may include, for example, either a cooled RF-driven electrode or a cooled ground electrode, or two cooled electrodes, wherein active components of the plasma may be directed out of the plasma and onto an internal or external substrate with or without simultaneously exposing a material to the electrical influence or ionic components of the plasma.

In some embodiments, the inventive subject relates to a atmospheric pressure plasma generating apparatus for producing a large area, non-thermal, stable discharge at power densities between about 0.1 $W/cm^3$ and 200 $W/cm^3$, but also capable of having a neutral gas temperature of at most about 50° C. In what follows, the term "atmospheric pressure" means pressures between about 500 Torr and about 1000 Torr. The active chemical species or active physical species of the plasma exit the plasma discharge before impinging on a substrate disposed outside of the discharge, thereby permitting substrate surface processing, without simultaneous exposure of the substrate to the electric fields or ionic components of the plasma. As stated, the plasma has a neutral gas temperature of less than about 50° C., even during prolonged and continuous operation, and species including gas metastables and radicals, as examples, may be generated. The high power densities, the lower operating plasma temperatures and the placement of the material to be processed exterior to the plasma, permit accelerated processing rates, and treatment of most substrates. The plasma source may be used for polymerization (e.g., free radical-induced or through dehydrogenation-based polymerization), surface cleaning and modification, etching, adhesion promotion, and sterilization, as examples.

In certain embodiments, the inventive subject matter is directed to the steps of: coating the surface of the substrate textile material with at least one silk polypeptide that is a monomeric precursor of a polymer having the chosen characteristic, and exposing the coated substrate to the active species generated in an atmospheric pressure inert gas plasma, whereby at least one monomeric precursor is polymerized, thereby forming the finish having the chosen characteristic. The monomer may be sprayed onto the substrate and introduced into the plasma chamber to cure. Or the monomer may be applied while the substrate is in the plasma chamber.

Pulsed or unpulsed, high-power plasmas may be used to produce durable coatings that may be applied using a plasma exposure of a second or less (as opposed to minutes), and that a continuously applied, effective power density for generating thicker, more durable coatings than those described in the prior art, may be between 1 and 5 $W/cm^2$ (This is between $10^2$ and $10^4$ times the power density reported for prior art plasmas.) The range of effective RF frequencies may include any ac frequency that generates a "sheath" or dark space near the electrodes when capacitively coupled to the electrodes. Typical frequencies may be between 40 kHz and 100 MHz.

According to the inventive subject matter, a dye or other colorant material may be deposited onto the fabric outside of the plasma region, and the coated fabric or other substrate subsequently moved into the inert gas plasma where products, such as metastable and ionic species, generated in the plasma induce chemical bonding of the dye to the fabric. The reaction process may have a penetrating effect atypical of most plasma processes; that is, the reaction commences on the substrate surface and propagates inward of the surface to where dye may have diffused.

According to the inventive subject matter, the use of atmospheric gas plasma, such as helium plasma, as an example, avoids chemical attack or degradation of the applied colorant by fragmentation. Notably, the condition of atmospheric pressure thermalizes ions produced in the plasma. Therefore, the metastable and ionic species produced in the plasma are effective for inducing reactions, while remaining otherwise chemically unreactive. Other possible inert carrier gasses include argon, krypton, neon, and xenon may also be used as inert plasma gases.

It is well known that increasing the power applied to plasma increases the thickness of the sheath, or "dark space", around an electrode. In capacitively coupled plasma, such as that of the present claimed invention, the sheath has a time-average electric field that repels electrons. It therefore appears dark to the eye because it has a substantially reduced concentration of electrons, which generate visible emission from gas phase species by excitation through electron impact. This reduced level of electron density in the sheath inhibits dissociation of the fluorocarbon monomer. Neutral metastables that are formed in the inert gas plasma can readily cross the voltage drop of the sheath and induce reactive species and reactions.

Electrons can only transit the sheath for a short portion of the RF cycle and do so only to the extent necessary to maintain charge equalization. Positively charged ions transit the sheath and would, in a vacuum-based plasma, impact the substrate with sufficient energy (10-100 eV) to fragment molecules, instead of simply creating reactive species. Therefore, in according to the inventive subject matter, a textile may be kept within the sheath region by placing it against either electrode or close thereto, where, high power applied to the plasma generates greater numbers of metastable species useful for initiating reactive species out of colorants condensed on the fabric, while avoiding the fragmentation of the colorants by energetic impingement of electrons or ions. In addition, plasma treatment processes for woven textiles and non-wovens may be substantially confined to the side of the substrate facing the plasma, if the substrate is held tightly against the electrode. Thus, selected treatments can be applied to one side or both sides of a fabric using a desired feedstock and a carrier gas plasma to induce reactions.

Additionally, atmospheric plasmas, as opposed to vacuum-based plasmas where a high DC bias is generated in the sheath region, effectively eliminates bombardment of the monomer on the substrate by energetic ions which would have the same destructive effect as the electron impingement. That is, in atmospheric pressure plasma, ions undergo frequent collisions with neutral gas phase species and thus do not acquire the kinetic energies they would otherwise develop in plasma operated under vacuum. In atmospheric pressure plasmas, ions are thermalized to near room temperature (.about.0.03 eV, as opposed to between 10 and 100 eV for vacuum-based plasmas), rendering such species incapable of providing destructive impacts. Further, the atmospheric plasma source hereof is a "symmetric" plasma; that is, the area of the parallel RF-driven and ground electrodes are equal, and there is no grounded chamber wall contributing to the electrical behavior of the plasma. Thus, there is no DC bias, and the power density may be $>10^4$ times higher than the power density suggested in the vacuum-based plasma of U.S. Patent Application Publication No. 2004/0152381. As used herein, "atmospheric pressure" plasmas are defined as operation of the plasma at a total gas pressure sufficiently high to create a plasma sheath in which collisions are effective for thermalizing the ions crossing the sheath. Typically, this occurs at pressures between 300 Torr and 3000 Torr. It is anticipated that pressures between 600 Torr and 800 Torr will be commonly employed.

The use of an inert carrier gas plasma, such as helium, is best suited for colorants that are transformed into species with free radicals. Inert gas plasma has the advantage of being capable of triggering the free radical reaction processes without chemically modifying the colorant. In some situations, however, it may be advantageous to add a minor amount of reactive gases, such as $H_2$, $N_2$, $NH_3$, or $CF_4$, as examples, to the inert gas to alter the properties, performance or composition of the substrate, colorant, and/or the complex of substrate and colorant. The use of such gases in amounts typically less than 20% of the total gas flow, may be useful to drive other forms of polymerization, such as condensation reactions or cross-linking between polymer chains.

Some colorants may be in the nature of monomers that form a polymerized coating on the surface of the substrate. The addition of $H_2$ might be helpful in promoting the polymerization of such a monomer that requires the loss of an —OH group through a condensation reaction. Similarly, the use of $N_2$ or $NH_3$ might promote crosslinking of a polymer chain, leading to greater durability for the resulting polymer.

In accordance with certain possible embodiments of the inventive subject matter, separate process modules operating at atmospheric pressure may be employed for: (1) condensing a colorant on a substrate; and (2) exposing the condensate to an atmospheric pressure plasma. Alternatively, the condensation of the colorant and the plasma process may be accomplished in the same module, not separate modules. Typically this would mean keeping a constant outward flow of helium or other inert carrier gas so as to keep the colorant vapor away from the plasma region. The two-module process has benefits for providing fastness or durability of the colorant on the substrate, and for avoiding unwanted colorant vapor deposition on the electrodes of the plasma system. Under such systems, since deposits do not form on the electrodes, the textile treatment system may be operated continuously and with less maintenance than where the gas-phase deposition species is formed in the plasma.

Examples of textile materials include, but are not limited to, textiles made of fibers of animal or plant origin, such as wool, silk, collagen, cotton and other cellulosics, synthetic fibers such as poyolefin fibers, polyesters, polyamides (i.e., nylons), fibers from liquid crystalline polymers (e.g., aramids), polyoxymethylene, polyacrylics (i.e., polyacrylonitrile), poly(phenylene sulfide), poly(vinyl alcohol), poly (ether ketone) (i.e., PEEK), poly[2,2'-(m-phenylene)-5,5'-bibenzimidazole] (i.e., PBI), poly(blycolic acid), poly (glycolic acid-co-L-lactic acid, and poly(L-lactide), aromatic polyhydrazides, aromatic polyazomethines, aromatic polyimides, poly(butene-1), polycarbonate, polystyrene, and polytetrafluoroethylene, as wells as combinations of the foregoing. Such combinations may allow for enhancement of certain desired fiber properties, as well as certain aesthetic coloring results, by dye curing on different fiber combinations in the substrate. Typically, the textile materials or other substrates would be provided and processed as sheets or other planar forms of material. However, the substrates subjected to coloration under plasma treatment may also be the fibers or yarns used in the weaving or knitting of a textile. However, persons skilled in the art will appreciate that other substrates may include yarns, threads, fibers and other such filamentous materials; membranes and films, for example, those used as full, partial, or selective barrier layers that control environmental conditions, e.g., waterproofneess, water resistance, breathability, and/or windproofness. An example of a waterproof, breathable membrane material is expanded PTFE, which may be sold under the brand name GoreTex.

In addition to substrates having a planar or sheet form, or a filamentous form, the substrate could have a volumetric 3D form. For example, the form could be material on a shoe last representing some or all the volume of the shoe last. The substrate could be a backpack or other article for containing items. The substrate in planar, filamentous, or 3D form could be a foam object used in construction of footwear, apparel, backpacks and other carriers, furniture or upholstery, etc. Foamed materials include EVA and PU. The substrate could likewise be any natural or synthetic rubbers or leathers.

The composite of colorants and substrates contemplated herein may be referred to herein as "constructs". Colorants may be affixed to the underlying substrate in a construct by any known chemical bond or bonding force, including covalent bonding, hydrogen bonding, van der Waals forces, ionic bonding, and physical entrapment. The colorants may be applied in uniform thickness or varying thickness. In the case of the polymeric coatings, the monomeric units form a monolithic structure over the underlying portion of the substrate. In other cases, the monomeric does not necessarily bond monomer-to-monomer but bonds monomer to substrate reactive site to form a permanent coating on the underlying portion of the substrate. (In other words, the monomers are not formally monomers but reactants combining with the substrate.) In the case of variable thickness coating, the coating thickness may be considered the average thickness on the surface. For many applications, the coating has a thickness of between 1 nm and 1 mm or 10 nm and 100 μm, or between 40 nm and 50 μm, or between 0.5 μm and 10 μm, or between 1.0 μm and 5 μm. These ranges are representative and the inventive subject matter encompasses a wide range of thicknesses and is not intended to be limited to the examples specifically given.

Applied colorants would typically be applied coextensively with a desired surface area of a substrate. In other words, the applied area would generally correspond to the entire surface area selected. However, this is not to say that the entire area is covered with a solid or continuous area of coverage. For example, in the case of coatings, they may be in the nature of, for example, a web, porous membrane, network of regularly spaced perforations, or other nonsolid patterns that are generally coextensive with the defined surface area. The coating may have varying topology, with some areas being thicker than others. The coating may also include two-dimensional or three-dimensional features. For example, microelectronic devices, sensors, circuits or traces can be integrated into a coating to provide functional features.

Colorants, either as integrated or dispersed molecules in the surface of a substrate or as discrete layers, i.e., coatings, may be applied in any desired patterns or colorways. For example, screens may be applied over substrates to create desired patterns for application of one or more colorants of the same or different colors. For specific color effect, for example, a screen can be placed in front of the spray system (between spray and substrate), creating a patterned spray on the substrate prior to cure. For some designs of certain repeating patterns, for example, a roller can be affixed in front of the spray to change the colored pattern where the repeat is the size of the roller diameter. Following this, the substrate can be processed again with a different screen and different colorant to create a multi-colored pattern on the substrate. In addition, the spray nozzles can be arranged to each have a different colorant. The colorants may be applied sequentially in a single plasma operation or in separate batch operations.

According to the desired output of multi-color designs, and repeated or not repeated patterns, it is envisioned that prior to the plasma cure, the substrate may be colored by a printing process, for example an inkjet printing process. After exiting the inkjet printer, typically in roll to roll form, the fabric may undergo a slight IR quick cure to prevent off-take from rollers before a plasma cure. Then the dye or other colorant is permanently cured in the plasma. In certain cases, for a faster process, the substrate can pass through the inkjet printer or other printing apparatus and run directly into the plasma for immediate curing.

It is also envisioned that the solution containing the dye can contain other elements within the dye to alter the substrate performance. The prior art has shown the ability to cure, in atmospheric plasma, both water repellent and anti-microbial finishes. As an example of this, the solution can contain dye colorants necessary to dye the substrate, protein monomers, and a water repellent chemistry sprayed onto the fabric and then cured in the plasma. This process can be in one spray system or follow the application of inkjet dyes onto the substrate in the described in the aforementioned paragraphs. The inventive subject matter contemplates that any combination of performance finishes (water repellency, fire retardents, anti-microbials, wicking agents, protein deposition, etc.), both known and yet to be discovered, may be included with the dye solution and applied at the same time as the dye or in series with a dye process to be cured in the atmospheric plasma with the dye.

For apparel applications, the treated surface area would generally be at least 6 square inches but could be substantially more less depending on the desired end result. For batch-processed rolls of materials for apparel applications, the coated surface area of the rolled material would typically be at least between about 50-72 inches in width and between about 1-100 meters in length. The roll length depends on the fabric material and construction. For example fleece would be bulky and ship in rolls of short lengths, while a 10-20 Denier downproof fabric could ship in higher length rolls. For apparel applications, such materials could be used for, in whole or part, an outer, intermediate, and/or inner layer of an apparel item.

Turning now to FIG. 1, a schematic representation of a perspective view of one embodiment of apparatus 10 for inert gas, atmospheric plasma polymerization treatment of substrates, is shown. Vessel 12, which may be heated or unheated, contains a feedstock 13, e.g., a feedstock that includes at least one colorant plus any desired additives. The feedstock is drawn out of vessel 12 through a heated or unheated tube 16, in which valve 18 is inserted in the direction shown by arrow 20 into a heated or unheated metering pump 22. Temperatures of the various components are maintained to reagents in a liquid state. A regulated and constant flow of the feedstock exits metering pump 22 through heated or unheated line 24, and is directed into an vaporizer unit 26, which converts the feedstock into a vapor, namely a gaseous, aerosol, or atomized stream of a liquid or solid feedstock. (The vaporizing unit and related steps are not necessary if the feedstock 13 held in vessel 12 is already in gas or other vapor form.) Inert gas stream 28 may be introduced into vaporizer 26 from gas source 30, to direct the flow of vapor out of vaporizer 26 and into applicator 32, which includes a nozzle that faces a substrate, e.g., a fabric, 34, such that gas stream 36, containing the volatilized feedstock is directed onto fabric 34. Fabric or nonwoven substrate 34 is moved in the direction of arrow 38, such that the fabric is not heated by hot gas stream 36, and the volatile feedstock constantly condenses onto a fresh section of fabric. The feedstock chemicals may be applied to fabric 34 inside chamber 40, which helps to keep the vapor away from plasma region 42, in order to avoid generation of unwanted chemical radicals and unwanted film deposits on electrodes 44 and 46. After condensation of the feedstock on the surface of fabric 34, the fabric passes into atmospheric-pressure enclosure 48. Enclosures or chambers 40 and 48 include exhausts 50 and 52, respectively. The terms "enclosure and chamber" are used interchangeably. That does not necessarily mean a completely enclosed bounded space, as in a hermetic chamber. An enclosure or chamber may have open sides or openings in walls.

In enclosure 48, fabric 34 passes between electrodes 44 and 46, which are part of the atmospheric pressure plasma source, where inert gas plasma 42 is generated. This plasma, which may be continuously maintained, is operated at power levels between 0.25 and 4 $W/cm^2$. For many applications power levels between 1 and 2 $W/cm^2$ are employed. Inert gas stream 54 from source 30, which may also supply inert gas to vaporizer 26 is the plasma gas. This condensation or deposition of the colorant from the feedstock, followed by plasma-induced color-setting reactions, may be repeated a chosen number of times for generating multiple deposits or coats of colorants, each formed on the previous application, for greater fastness and durability. As stated above, one or more of the plasma discharges 42 may also employ an inert gas mixture including minor additions of reactive molecules, such as $H_2$, $N_2$, $CF_4$, or $NH_3$, as examples, to promote reactions.

Region 56 denotes the section in which no colorant is present (colorant may be present when multiple applicators and plasmas are employed, in which case region 56 would have colorant from an earlier treatment process); region 58 identifies the section in which colorant feedstock chemicals are applied; region 60 denotes the plasma polymerization region which sets, cures, polymerizes, cross-links or otherwise binds the chemicals applied by the vaporizer/applicator; and region 62 identifies the region in which the fabric has been treated at least once. Not shown in FIG. 1 are: (1) the radiofrequency plasma power supply and matching network connected to the electrodes 44 and 46, and used to power and tune plasma 42; (2) water-cooling used to cool the electrodes 44 and 46 such that the gas temperature of the plasma may be maintained at or below 70° C.; (3) the compressed gas regulators for source 30; (4) the driver and rollers used to move fabric 34 across the applicator region, into the plasma region, and out of the plasma region; and (5) the pumps in exhausts 50 and 52 for collecting and recycling the inert gas, all of which are well known to persons of ordinary skill in the art. Fabric 34 may be held against one electrode 46 to restrict the treatment process to one side thereof. Either electrode may be used for this purpose.

Although the applicator chamber or enclosure 40 and plasma chamber or enclosure 48 are shown as separate chambers or enclosures, the features and function of each may be provided under a common enclosure. For example, the applicator 32 and plasma source, i.e., electrodes 44, 46 for generating plasma region 42 could be in a single enclosure. (See, e.g., FIGS. 2-3, discussed below.) The applicator could be operated simultaneously with the operation of the plasma-generating electrodes or the applicator and electrodes could be operated sequentially. The applicator could be a separate apparatus in the system that operates independently of the feed inlet for the carrier gas or it could be integrated with the feed inlet for the carrier gas such that the colorant feedstock and carrier gas are in a single common stream that is introduced into the common enclosure and subjected to the electrical field for generating plasma.

In addition to the single set of applicators and plasma sources, a series of applicators/plasma sources could be used to provide multiple deposits or layers of colorant on a single substrate. Similarly, in a single set of an applicator/plasma source, multiple layers of deposits or coatings could be applied by reversing the movement of a substrate coated after a first operation of the applicator and plasma source back to the applicator and then to the plasma source for a second operation of the applicator and plasma source.

Typical dimensions for the electrodes for an exemplary laboratory plasma apparatus are between 1 cm and 13 cm wide, by 30 cm long, with a gap of between 1 and 2.5 mm. Typical voltages may be between 120 and 450 V (peak-to-peak) at frequencies including 13.56 MHz, 27.1 MHz and 40.68 MHz.

The inventive subject matter is suitable for a continuous operation in which the colorant feedstock mixture is first applied to the substrate, and then the substrate that is deposited with condensed colorant feedstock (neat or applied with other chemicals). The treated substrate is then moved into an atmospheric pressure plasma, whereby an inert gas plasma is used to cause the setting of the colorant to the substrate. In addition, the inventive subject matter is suitable for the direct addition of the colorant feedstock into plasma cloud via a mist and is immediately deposited and cured on the substrate. By operating the plasma at sufficiently high power (>0.25 W/cm$^2$, typically between 1 and 2 W/cm$^2$), it should be possible to treat substrates at a web speed of at least, for example, 10-100 m/min and using a electrode dimension (in the direction of web travel) of, for example, 10-200 cm. Operation at atmospheric pressure means that pre-conditioning of the fabric to a pre-set moisture level is not necessary. It is also not necessary to pulse the plasma, thereby enabling greater throughput of the apparatus, because the duty cycle of the treatment process is 100%.

Another example of a plasma apparatus, which may be used in methods according to the inventive subject matter, is shown in FIGS. 2-3. In principle, the apparatus allows for a fast flow of active chemical or physical species generated in the plasma region between electrodes to exit the plasma region and impact the substrate before the active species are deactivated by collisions or loss of energy, thereby generating chemical and/or physical changes to the substrate without exposure of the substrate to the electrical field or charged components that are present inside the plasma. This effect is achieved by creating a "plasma protrusion" from the hollow cathode effect formed between parallel openings in the ground or RF electrode and using these protrusions to assist in carrying active species further downstream from their point of generation. In the present situation, the hollow cathode effect is produced between the grounded, liquid-cooled tubular or oval electrodes that efficiently cool the electrode and through which the active species flow following generation inside the plasma. An advantage of using circular or oval tubes to form the ground electrode, as opposed to using a plurality of water-cooled rectangular or square electrodes having similar aspect ratios, is that the oval or round electrode configuration avoids sharp edges that would perturb and undesirably enhance the discharge in the vicinity of the edge, due to the locally-enhanced electrical field that would result from the relationship, E=V/r, where r is the radius of curvature of the edge, V is the applied, instantaneous voltage on the electrode, and E is the electric field. An enhanced electric field is likely to induce arcing. As stated hereinabove, this downstream processing approach also inhibits exposure of the substrate to charged species formed inside the plasma because of rapid recombination of such species once they leave the plasma.

FIG. 2 is a schematic representation of a perspective view of one embodiment of plasma processing apparatus 110, is shown, illustrating RF electrode 112, having liquid cooling ducts 114*a*-114*d*, powered by RF power supply and RF matching network 116, connected to electrode 112 using a copper or other metal ribbon (not shown in FIG. 2), and supported by insulating members 118*a*-118*c*, which may be fabricated from fiberglass, G10/FR4 (McMaster-Carr), a phenolic resin PTFE, glass or ceramic, as examples, whereby first chosen spacing 120, between RF electrode 112 and planar ground electrode 122, constructed using parallel, grounded, hollow circular or oval tubes, 124*a*-124*d*, is maintained. Electrical energy is supplied in a frequency range between about 1 MHz and about 100 MHz, the RF matching network being used to adjust for a load deviation from 50 Ohms in the apparatus. Chiller 126 supplies liquid coolant to cooling ducts 114 *a*-114 *d* and to hollow tubes 124*a*-124 *d* adapted for liquid cooling. Either rectangular or circular tubing may be used in place of cooling ducts 114*a*-114*d*. Material to be processed 128 is disposed outside of the plasma in the proximity of ground electrode 122 and maintained spaced-apart therefrom at second chosen spacing 130. Material 128 may be moved during processing using an appropriate moving apparatus 132. Gas inlet tubes 134*a*-134*c*, supplied by gas supply and manifold 136, provide the appropriate gas mixture to gas distribution tubes 138*a*-138*c*, nominally ⅜ in. O.D., there being at least one gas inlet tube 134*a* for each gas distribution tube 138*a*, as an example, to maintain approximately constant gas pressure across gas distribution tubes 138*a*-138*c*. Gas distribution tubes 138*a*-138*c* may be made from plastic, Teflon or metal, as examples. Clearly, additional inlet tubes 134 would be provided to accommodate wider RF electrodes 112. Gas distribution tubes 138*a*-138 *c* have holes (not shown in FIG. 1) spaced apart along the length thereof and facing grounded electrode 122, such that gas emerges through tapered channels 140*a*-140 *c*, opening out of bottom surface 141 of RF electrode 112. Tapered channels 140*a*-140*c* hold gas distribution tubes 138*a*-138*c* firmly in place, and recessed from surface 141. Radiofrequency electrode 112 is shown to be divided into two opposing portions 112*a* and 112*b*, such that the channels 114*a*-114*d* and 140*a*-140*c* may be readily machined and gas distribution tubes 138*a*-138*c* may be installed, and for cleaning and maintenance as needed during operation of discharge apparatus 110. The three gas distribution tubes 138*a*-138*c*, shown in FIG. 2, may be separated at 2.5 in. intervals center-to-center, and recessed from face 141 by 0.125 in. In another embodiment of the inventive subject matter, O-rings can be used to confine the cooling liquid to cooling ducts 114*a*-114*c* in opposing portions 112*a* and 112*b* if tubing is not employed. To prevent loss of process gas through the sides of apparatus 110, gas flow is blocked by sealing the space between the first and last of grounded tubes 124*a*-124*d* and insulating members 118*b* and 118*c*, such that the direction of gas flow is always through the opening between grounded tubes 124*a*-124*d* (not shown in FIG. 2).

FIG. 3 is a schematic representation of a side view of plasma processing apparatus 110 hereof, illustrating gas supply tube 134*b*, water cooling channels 114*b* and 114*c* for RF electrode 112, recessed gas distribution tube 138*b*, tubular ground electrode 122, and material 128 disposed downstream of the plasma which is formed in first spacing 120. Shown also are radial holes 142, which permit gas to flow out of gas distribution tube 138*b*, into tapered channel 140*b*, and out of surface 141 of RF electrode 112*b*. Holes 142 may be 0.03 in. in diameter. The gap between adjacent grounded electrode tubes 124*a*-124*d* may be between about 0.03 in. and 0.12 in. It is believed that between two plasma discharge apparatuses: one having an electrode gap of about 0.12 in. and another having an electrode gap of about 0.093 in., the latter apparatus, having more grounded tubes for the same size of electrode 22, will give better results for the same flow conditions. The difference may be the result of a higher "downstream" gas flow velocity achieved with the smaller gap, and better gas cooling because of the increased area of the tubes.

As stated above, effective cooling of the RF electrode may be achieved by sandwiching square copper or aluminum tubing 114*a*-114*d* between top and bottom sections 112*a* and 112*b* of RF electrode 112 which may also be made from aluminum, and flowing thermostatically-controlled, chilled water from chiller 126 which cools RF electrode 112 by conduction. Because neither RF electrode 112 nor grounded electrode 122 are covered with a dielectric material, thermal conduction between the electrodes and the gas is greatly enhanced, enabling effective and efficient gas cooling. Grounded electrode 122 includes a series of parallel, equally-spaced tubes 124*a*-124*c* through which cooling water is also flowed utilizing chiller 126. Cooling ducts or tubes 114*a*-114*d* of RF electrode 112 and tubes 124*a*-124*d* could well be cooled by other fluids, such as a glycol-based coolant, or a chilled gas, as examples. Because of the high surface area provided by tubes 124*a*-124*d* of grounded electrode 122, gas cooling is enhanced relative to a water-cooled planar electrode. For tubes having ¼ in. outside diameter (O.D.), and a gap of about 0.09 in. open area between the tubes, the increase in surface area over a planar electrode is a factor of about 2.2. Thus, the downstream gas flow onto the substrate or substrate may be effectively cooled. When oval-shaped ground electrode tubes 124*a*-124*d* are used, the short dimension of the tube is perpendicular to RF electrode 112 and the long dimension thereof is parallel to RF electrode 112.

Flowing gas is employed to generate the plasma and to carry active components produced in the plasma discharge between the RF and ground electrodes in spacing 120, out of the plasma through the spaces between the tubes 144*a*-144*d* (FIG. 2), of grounded electrode 122, and onto substrate 128. One gas mixture effective for this purpose includes between about 85% and about 100% helium flowing from gas supply 136 (FIGS. 2 and 3) into gas inlet tubes 134*a*-134*c* and into gas distribution tubes 138*a*-138*c*, also shown in FIGS. 2 and 3 hereof. Other gases or vaporized substances may be added to the helium flow to enhance the formation of active species inside the plasma volume. Distribution tubes 138*a*-138*c* are fitted with small openings 142 to permit the gas to exit the distribution tubes from the side of the electrode facing the plasma. By placing these distribution tubes within gap or channels 140*a*-140*c* respectively, machined into electrode 112, the distribution tubes are kept out of the active region of the plasma, as are the gas outlet openings. The channels do not permit plasma formation in immediate vicinity thereof, because the inter-electrode gap between the RF and ground electrode is too large for a discharge to occur. The gas distribution tubes are disposed away from the discharge in order to prevent arcing events that occur due to an enhanced hollow cathode effect which may occur in small openings, in a similar manner to those in micro-hollow discharges. Three rows of gas distribution tubes have been found to be sufficient to achieve uniform processing for an RF electrode 112 that is 2 m×0.3 m, the longer dimension being parallel to distribution tubes 138*a*-138*d*, as shown in FIG. 3, and with the axis of the gas distribution tubes being perpendicular to the movement of material 128.

As stated above, gas flow from the plasma is prevented from exiting the plasma region except through the narrow space between the tubes. Even though significant electrical power (between about 10 W/cm$^3$ and occasionally greater than about 100 W/cm$^3$) is deposited into the plasma, which adds thermal energy to the process gas, efficient gas cooling effected by the water cooling system and the absence of thermal insulators (such as electrical dielectric covers) on the tubes and the RF electrode keep the gas temperature low. This may be significant, for example, when the present plasma discharge apparatus is used for surface polymerization of thin-film monomers since brief exposure to a hot gas will cause condensed monomer on the substrate to rapidly vaporize and escape from the system.

Material 128 may be moved perpendicular to the parallel alignment of the grounded electrode tubes, which provides a uniform, surface treatment because all areas of the surface are exposed to the gas flow. The gap between the material and the bottom of the tubes can also be controlled and varied. This gap is typically between about 0.5 mm and about 10 mm. A large gap enables the apparatus to polymerize monomer applied to thick substrates, such as deep-piled carpet, but also has the disadvantage that some of the active chemical species flowing out the plasma will recombine, or deactivate by other time-dependent means (such as by radiation or collisions), leading to slower processing. A small gap between the material and the tubes has the advantage of minimal deactivation of active species, but also is more prone to contaminating the plasma volume between the RF and ground electrodes by mixing of any volatile vapors from the material with the process gases. The ability to treat materials that may emit vapors from other processing steps is a significant advantage since treatment of such materials using any of the in-situ processing methods would result in contamination of the process gas by the emitted volatile vapor, or would require such high gas flow as to be prohibitive in cost. Close spacing of the tubes also allows the plasma gas to exit towards the material at a higher velocity, because the gas flow is directed through a smaller space, which increases the linear velocity of the gas, but without a concomitant increase in gas consumption, and thereby operating cost.

If the substrate or material were to be held static in the apparatus, the result would be stripes of treatment, each stripe corresponding to a gap between the grounded electrode tubes 124*a*-124*d*. By moving the substrate across the apparatus in a uniform manner and in a direction normal to the ground electrodes, uniform surface processing has been achieved. This provides for continuous treatment of a material, either in an in-line process or a stand-alone batch process. Substrate or material 128 may include flexible materials such as textiles, carpet, plastics, paper, metal films, and non-wovens, as examples, or rigid materials, such as glass, silicon wafers, metal and metal sheeting, wood, composite materials, cardboard, surgical instruments or skin, as examples. The substrate may be a laminate material.

The material may be moved using a conveyor belt, moving stage, or through other means of locomotion. Because the substrate is outside of the plasma and the electrical fields therein, movement thereof is not complicated. The distance between the substrate and the exit of the plasma-generated species between grounded electrode tubes 124*a*-124*d* is adjusted such that the deactivation or decay of the active species has not destroyed the chemical reactivity of the gas stream in the downstream region. Placement and movement of the substrate between 0 mm to about 10 mm from the surface of grounded electrode tubes 124*a*-124*d*, may satisfy this condition, depending on the process chemistry.

In summary, in one possible embodiment, stable, non-arcing operation of the plasma requires three conditions to be satisfied: (a) a flow of a process gas consisting of between about 85% and about 100% helium, for example; (b) RF excitation of one electrode in the frequency range of between about 1 MHz and about 100 MHz with bare metal electrodes exposed to the plasma; and (c) a gap between the RF-driven electrode and the ground electrode that is between approximately 0.5 mm and approximately 3 mm. It is believed that a spacing of about 1.6 mm when an RF frequency of about 13.56 MHz will obtain satisfactory results (and at slightly smaller distances for higher frequencies). Additionally, low-temperature operation (that is, between about 0° C. and about 100° C., or between 10° C.-35° C.) requires efficient cooling of both electrodes using a temperature-controlled fluid, such as chilled air, ethylene glycol or distilled water, as examples. The use of conductive fluids, such as brine, is undesirable because of the corrosive effect of the brine as well as the electrical leakage of radiofrequency power that may result.

In some embodiments where the colorant may be applied as a discrete, layered coating, the coating on a textile substrate is between 1 nm and 1 mm, or 10 nm and 100 μm, or between 40 nm and 50 μm, or between 0.5 μm and 10 μm, or between 1.0 μm and 5 μm. These ranges are representative and the inventive subject matter encompasses a wide range of thicknesses and is not intended to be limited to the examples specifically given. 1 nm-20 nm should suffice for alterations of surface characteristics. However, thicknesses exceeding 20 nm may be needed to ensure the ability induce a tactile change in the surface of the fabric.

In some embodiments, consistent with the teachings in U.S. Pat. No. 8,016,894 for side-specific plasma treatment, one side of the coated textile may be exposed to the plasma, while the other side of the textile is maintained in close proximity to a surface impervious to the plasma species. In this manner, the plasma may selectively modify (e.g, coat) one side of the textile. The side of the fabric facing the impermeable surface is protected from modification by the chemical species generated in the plasma. It should be mentioned that whether the fabric is pressed against the impermeable surface with some force or simply adjacent to the surface, or in the vicinity thereof, will depend on how much of the protected surface can be removed or modified without rendering insignificant the difference in properties between that surface and the surface deliberately being processed or removed. To process large quantities of fabric, the textile may be moved through the plasma at chosen speeds such that the textile spends an effective amount of time in the plasma. In some situations the plasma treatment may provide functional ligands having additional desirable properties to the surface of the fabric on the side facing the plasma; the coating on the protected side is retained essentially as coated, and may have different functionality than the plasma-processed side. The present apparatus and method may therefore be used to achieve a desired dual-functionality fabric.

Feedstock

The dope or feedstock solution used in the methods according to the inventive subject matter may be a solution or dispersion or other mixture or composition that includes or comprises any colorant contemplated herein. Typically, the dye may be provided in an appropriate stable and usable form based on the known chemistry of the dye and conventional known solutions for a given dye. In this respect, typically, the dye manufacturer will be able to provide the dye in an appropriate solution or with specifications for use. But generally speaking, to produce stock solutions of dyes, dye powder is diluted with water or other solvent. Various known additives necessary for the dye process may be added to the solution. Additives include salts to drive movement of dye, anti-caking and anti-dusting agents, etc. In commercial-scale applications, drums of the dye solutions are then sent to a factory for a specific shade/application. At the factory the solution can be diluted multiple times before the dye reaches the fabric. This dilution will change the shade of the fabric to desired degree.

In the case of reactive dyes (e.g., for application to cotton or wool) a typical stock solution is about 8% dye, where 70% of this can be salts and the remaining concentrate water or other solvent. The salts help drive the reaction of the dye from the solution into the fiber. Shade of color is changed by the amount of dye added to a solution. Typically, reactive dye is applied using a cold-padded batch process that does not use high temperatures. The fabric is then placed in a steam chamber to drive the reaction. Because plasma can mimic high temperature reactions, plasma can replace the steam chamber process. Additionally, because plasma can activate the dye molecules as well as the fabric surface (driving the reaction), salts in the dye solution are not necessary to drive the reaction. Therefore, the stock solution of a reactive plasma dye can be a highly concentrated mixture of dye in a solvent. According to the methods of the invention, the feedstock solution may be produced and/or used for plasma processing at a temperature in the range of 0° C. to 100° C. for many applications.

In the case of disperse dyes (polyester) the stock solution could contain some salts and anti-agglomeration chemistry to keep the dye molecules suspended. For the case or reactive dyes and disperse dyes, the stock solutions would be high concentrations of the dye and require few, if any, other additives in the stock solution as compared to traditional dye methods. The dye is then atomized as a mist into the plasma As used herein, the term "solution" is a broad term that includes not only solutions proper but also suspensions and colloids. The solvent used for the dope solution may be any aqueous solution in which a colorant is soluble or dispersible. Hereinafter, a "solvent" is any liquid that may be used for creating dissolved or dispersed particles. Similarly, references to "dissolving" and like terms, means the act of dissolving or dispersing for purposes of forming a solution proper, suspension or colloid.

From the foregoing teachings, persons skilled in the art will appreciate that various desirable properties or characteristics may be imparted to textile materials and other substrates. Such properties or characteristics, as used herein, include, improved: haptic or hand (e.g., fabric softening), strength, durability, elasticity, fire retardancy, water and/or oil stain repellency, wicking ability, insect-repellency, anti-static properties, fade resistance in sunlight and lighting conditions, and anti-microbial properties to reduce odor, infection, and formation of mold or mildew. The dyeing and/or treatments may be selectively or preferentially applied to both sides of fabric substrates or selectively or preferentially to one side or the other. Similarly dyeing and treatments may be selectively or preferentially applied to desired zones on the substrate. The selected or preferential treatment may revolve around the same or dissimilar chemistries. For example, different zones may be treated with the same composition but in different amounts for tailored performance requirements for each zone.

The principles described above in connection with any particular example can be combined with the principles described in connection with any one or more of the other examples. Accordingly, this detailed description shall not be construed in a limiting sense, and following a review of this disclosure, those of ordinary skill in the art will appreciate the wide variety of lending systems and other systems that can be devised using the various concepts described herein. Moreover, those of ordinary skill in the art will appreciate that the exemplary embodiments disclosed herein can be adapted to various configurations without departing from the disclosed principles.

The previous description of the disclosed embodiments is provided to enable any person skilled in the art to make or use the disclosed innovations. Various modifications to those embodiments will be readily apparent to those skilled in the art, and the generic principles defined herein may be applied to other embodiments without departing from the spirit or scope of this disclosure. Thus, the claimed inventions are not intended to be limited to the embodiments shown herein, but are to be accorded the full scope consistent with the language of the claims, wherein reference to an element in the singular, such as by use of the article "a" or "an" is not intended to mean "one and only one" unless specifically so stated, but rather "one or more". Moreover, nothing disclosed herein is intended to be dedicated to the public regardless of whether such disclosure is explicitly recited in the claims. No claim element is to be construed as "a means plus function" claim under US patent law, unless the element is expressly recited using the phrase "means for" or "step for".

All patent and non-patent literature cited herein is hereby incorporated by references in its entirety for all purposes.

The invention claimed is:

1. A method of treating a substrate, comprising:

providing a substrate comprising a textile having a generally sheet or planar form or a substrate comprising a fiber or yarn form;

providing a colorant to be set at the surface of the substrate; and at about atmospheric pressure, subjecting the substrate and the colorant to reactive species from a plasma generated by an atmospheric plasma apparatus until the colorant affixes to the substrate via chemical bonding to a desired color, wherein the energy of the plasma is sufficient to overcome bond energies to cause permanent bonding of the colorant on the substrate, without the substrate being immersed in a dye bath and without subjecting the substrate and colorant to a separate thermal fixation step, and wherein the affixing of the substrate provides a wash durable coating on the substrate and the change of color without negatively affecting the bulk properties of the substrate.

2. The method of claim 1 wherein the substrate includes a colorant that is deposited on the surface of the substrate before the substrate is subjected to the reactive species of the plasma, and wherein once the substrate with the colorant is subjected to the reactive species, the reactive species facilitates the affixing of the colorant at the surface of the substrate.

3. The method of claim 1 wherein the colorant is deposited on the substrate after the substrate is placed in a chamber of the plasma apparatus.

4. The method of claim 1 wherein the colorant comprises a dye that is fed into the plasma-generating electrical field of plasma apparatus and the dye and/or surface sites on the substrate are transformed into reactive species such that the dye and substrate chemically bond together.

5. The method of claim 1 wherein the substrate is placed within the plasma-generating electrical field of the plasma apparatus.

6. The method of claim 1 wherein the substrate is placed outside the plasma generating electrical field of the plasma apparatus but in communication with the reactive species generated in the plasma, the reactive species facilitating the fixing of the substrate to the colorant and/or of the colorant to itself so as to affix the colorant into a coextensive coating on the surface of the substrate.

7. The method of claim 1 further comprising:

applying the colorant to the substrate by inkjet printing, supercritical $CO_2$ dyeing, or solution dyeing; and then subjecting the textile to the reactive species until the affixing of the colorant on the substrate is completed to the desired degree.

8. The method of claim 1 wherein the colorant is selected from the group of: acid dyes, basic dyes, disperse dyes, direct or substantive, mordant and chrome, pigment, organic, solvent, azoic, sulfur, acetate rayon dyes, nylon dyes, cellulose acetate dyes, and vat dyes.

9. The method of claim 1 wherein the colorant is selected from the group of: azo dyes, anthraquinone dyes, benzodifuranone dyes, polycyclic aromatic carbonyl dyes, indigoid dyes, polymethine and related dyes, styryl dyes, di- and tri-aryl carbonium dyes, phthalocyanine dyes, quinophthalone dyes, sulfur dyes, nitro and nitroso dyes, and miscellaneous dyes.

10. The method or construct of claim 1 wherein the substrate comprises a textile material.

11. The method of claim 1 wherein the substrate comprises a textile; and the colorant comprises a monomer to be set at the surface of the textile; and wherein the subjecting of the textile and/or the colorant to the atmospheric plasma conditions is sufficient to set the colorant monomer at a surface of the substrate; and continuing the conditions until the monomer polymerizes as a polymer layer at the surface of the substrate.

12. The method of claim 1 further comprising performing an etch operation on the substrate using a plasma, to create a desired surface texture at the surface of substrate; and then depositing the colorant on the surface under the atmospheric plasma; and allowing the colorant to affix the substrate to the desired degree.

13. The method of claim 1 wherein helium, argon, krypton, neon, and/or xenon gas is used as a carrier gas in generating the plasma.

14. The method of claim 2 wherein while subjecting the substrate and the colorant to the reactive species from the plasma generated by an atmospheric plasma apparatus, the plasma apparatus maintains the carrier gas at a temperature of about 50° C. or less.

15. The method of claim 2 wherein while subjecting the substrate and the colorant to the reactive species from the plasma generated by an atmospheric plasma apparatus, the plasma apparatus produces a stable discharge at power densities between about 0.1 W/cm3 and 200 W/cm3.

16. The method of claim 2 wherein while subjecting the substrate and the colorant to the reactive species from the plasma generated by an atmospheric plasma apparatus, the plasma apparatus produces a stable discharge at power densities between about 0.1 W/cm3 and 200 W/cm3 and maintains the carrier gas at a temperature of about 50° C. or less.

17. The method of claim 1, comprising: at about atmospheric pressure, subjecting the substrate and the colorant to the reactive species from the plasma until the colorant affixes to the substrate via a covalent bond.

18. The method of claim 1, comprising: providing electrical energy to the atmospheric plasma apparatus so as to generate the plasma using a frequency range between about 1 MHz and about 100Mhz.

* * * * *